US005962206A

United States Patent [19]

Hall

[11] Patent Number: 5,962,206

[45] **Date of Patent: *Oct. 5, 1999**

[54] MULTILAYER PHOTOGRAPHIC ELEMENT CONTAINING ULTRATHIN TABULAR GRAIN SILVER HALIDE EMULSION

[75] Inventor: Jeffrey Louis Hall, Rochester, N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/595,612

[22] Filed: Feb. 2, 1996

[51] Int. Cl.[6] ..... G03C 1/46

[52] U.S. Cl. ..... 430/506; 430/502; 430/503; 430/567; 430/569

[58] Field of Search ..... 430/502, 503, 430/567, 506, 569

[56] References Cited

U.S. PATENT DOCUMENTS

| | | | |
|---|---|---|---|
| 4,672,027 | 6/1987 | Daubendiek et al. | 430/505 |
| 4,693,964 | 9/1987 | Daubendiek | 430/505 |
| 5,217,858 | 6/1993 | Maskasky | 430/567 |
| 5,219,715 | 6/1993 | Sowinski et al. | 430/376 |
| 5,250,403 | 10/1993 | Antoniades et al. | 430/505 |
| 5,494,789 | 2/1996 | Daubendiek et al. | 430/567 |
| 5,503,971 | 4/1996 | Daubendiek et al. | 430/567 |
| 5,576,168 | 11/1996 | Daubendiek et al. | 430/567 |
| 5,582,965 | 12/1996 | Deaton et al. | 430/567 |
| 5,604,085 | 2/1997 | Maskasky | 430/567 |
| 5,614,358 | 3/1997 | Wilson et al. | 430/567 |
| 5,641,618 | 6/1997 | Wen et al. | 430/567 |

OTHER PUBLICATIONS

J. Imaging Science and Tech., 38 pp. 32–35 (1994).
Research Disclosure, May 1985, pp. 237–240.

*Primary Examiner*—Geraldine Letscher
*Attorney, Agent, or Firm*—Arthur E. Kluegel

[57] ABSTRACT

A photographic element comprises a support bearing two or more silver halide emulsion image-forming layers each containing ultrathin tabular grains or a support bearing at least three image-forming layers for forming images of different color in which at least one of the layers contains ultrathin tabular grains, wherein the imaging silver contained in the total of all the image-forming layers of the element is as described in subparts (1), (2) and (3):

(1) ultrathin tabular grains, having a thickness of less than 0.07 microns, comprise at least 25 wt % of the total imaging silver content of subparts (1), (2), and (3);

(2) (a) tabular grains of thickness at least 0.10 microns and (b) non-tabular grains having an ECD of at least 0.15 microns and less than 0.70 microns, comprise not more than 50 wt % of the total imaging silver content of subparts (1), (2), and (3); and (3) tabular grains having a thickness of at least 0.07 microns and a thickness less than 0.10 microns comprise not more than 50 wt % of the total imaging silver content of subparts (1), (2), and (3).

33 Claims, No Drawings

MULTILAYER PHOTOGRAPHIC ELEMENT CONTAINING ULTRATHIN TABULAR GRAIN SILVER HALIDE EMULSION

FIELD OF THE INVENTION

This invention relates to a photographic element of the successive layer type which contains a plurality of silver halide emulsion image-forming layers where the imaging layers in total comprise a significant portion of silver halide tabular grains having a thickness less than 0.07 micrometers.

BACKGROUND OF THE INVENTION

Over the past several years, photographic manufacturers have focused on ways of conserving a valuable silver resource by lowering the coated weight of light-sensitive silver halide in photographic elements (S. Honjo, *J. Imaging Tech.,* 15, 182 (1989)). However, it has been difficult to obtain a low silver-containing light sensitive material that does not compromise important image qualities like sharpness, speed, or graininess (European Patent Publication 0 629 909 ).

In Antoniades et al., U.S. Pat. No. 5,250,403, there are described photographic elements that use ultrathin tabular grain emulsions (less than 0.07 microns thick) in the topmost layer that provide distinct improvements in the specularity of the transmitted light and, thereby, an improvement in the acutance of underlying layers. In Sowinski et al., U.S. Pat. No. 5,219,715, there are described photographic elements having low coverage of certain tabular grain silver halide emulsions. However, the use of such ultrathin tabular grain emulsions is reported by one of the inventors in the above Sowinski patent to lead to significant speed losses (A. E. Bohan, G. L. House, *J. Imaging Science and Tech.,* 38, 32 (1994)) because of the high front surface reflectance of these thin emulsions (*Research Disclosure* 25330, May, 1985). Thus, when these ultrathin tabular grain emulsions are employed in so-called "successive layer" structures that are conventionally employed in color photographic materials, such as for example when a support has provided successively thereon a red-sensitive layer, a green sensitive layer, and a blue sensitive layer, either a loss in speed or a diminution in another important photographic property would be expected to result. It would be expected that the well-known high reflectance of thin tabular grains would lead to deterioration in graininess because larger projected area emulsions having poor graininess would be required to overcome the speed deficit expected from the light loss caused by reflectance. Further, image sharpness would be expected to degrade because of the multiple reflectances that would occur within the photographic element (internal reflectance) (*J. Imaging Science and Tech.,* 38, 32 (1994) and U.S. Pat. No. 5,290,674). Degradation of speed in layers underlying the layers containing the ultrathin tabular grains, degradation in granularity of these underlying layers, and degradation in multilayer acutance would be expected because of this reflectance thereby voiding the advantage of high specularity of transmitted light.

Daubendiek et al U.S. Pat. 4,672,027 reports a 3 mole percent iodide tabular grain silver bromoiodide emulsion having a grain thickness of 0.017 micrometer and thin tabular grain high chloride emulsions are disclosed by Maskasky U.S. Pat. No. 5,217,858 but the advantages of their use in a multilayer application are not recognized.

It would be desirable to have a multilayer photographic element which exhibits an enhanced combination of speed, graininess, and sharpness even when low levels of imaging silver are present in the element.

SUMMARY OF THE INVENTION

The present invention provides a photographic element which comprises a support bearing two or more silver halide emulsion image-forming layers each containing ultrathin tabular grains or a support bearing at least three image-forming layers for forming images of different color in which at least one of the layers contains ultrathin tabular grains, wherein the imaging silver contained in the total of all the image-forming layers of the element is as described in subparts (1), (2) and (3):

(1) ultrathin tabular grains, having a thickness of less than 0.07 microns, comprise at least 25 wt % of the total imaging silver content of subparts (1), (2), and (3);

(2) (a) tabular grains of thickness at least 0.10 microns and (b) non-tabular grains having an ECD of at least 0.15 microns and less than 0.70 microns, comprise not more than 50 wt % of the total imaging silver content of subparts (1), (2), and (3); and (3) tabular grains having a thickness of at least 0.07 microns and a thickness less than 0.10 microns comprise not more than 50 wt % of the total imaging silver content of subparts (1), (2), and (3).

The photographic element exhibits an enhanced combination of speed, graininess, and sharpness even when low levels of imaging silver are present in the element. The invention also provides a method for forming an image in a photographic element of the invention.

DETAILED DESCRIPTION OF THE INVENTION

As used herein, the term "tabular" grain refers to silver halide grains having a thickness of less than 0.3 micrometers (0.5 micrometers for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

Tabularity increases markedly with reductions in tabular grain thickness.

Concerning tabular grains in general, to maximize the advantages of high tabularity it is generally preferred that tabular grains satisfying the stated thickness criterion account for the highest conveniently attainable percentage of the total grain projected area of the emulsion, with 50% total grain projected area (% TGPA) being typical. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: *Research Disclosure*, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522;

4,806,461; 4,835,095; 4,853,322; 4,914,014; 4,962,015; 4,985,350; 5,061,069, 5,061,616; 5,219,715; and 5,290,674.

As used herein the term "imaging silver" is intended to have a particular meaning. It includes all silver present in the photographic element as a silver halide except that silver halide present in grains smaller than 0.15 $\mu$m ECD. It does not include silver which is not present in the halide form, such as that employed in elemental form for purposes other than forming an image such as for filter or antihalation purposes. Viewed mathematically, imaging silver includes the total silver in the element less the silver present in other than the halide form and less the silver present in the halide form in grains sizes less than 0.15 $\mu$m ECD.

As noted in the "Summary of the Invention", the ultrathin tabular grain comprise at least 25 wt % of the total grain content as described in subparts (1), (2), and (3). Ultrathin tabular grains are tabular grains having a thickness of less than 0.07 microns. The ultrathin tabular grains exhibit a desired balance between specularity and reflectivity that is believed to account for the overall advantages realized from the photographic element of the invention. The larger the content of ultrathin tabular grains the more the effect can be taken advantage of. If the ultrathin proportion constitutes at least 50 wt % and more suitably at least 65 wt % of subparts (1), (2), and (3), the desired benefits can be increased. Due to the recognized interchangeability of photographic properties, the advantages of the invention can be realized in speed, silver level, sharpness or graininess. For example, if the silver level is reduced, the reduction in the number of silver centers would be expected to result in a deterioration in the graininess of the image. The results of the invention are an improvement over the expected position.

From the standpoint of imaging silver content, the present invention permits the use of a photographic element having a reduced silver laydown and correspondingly thinner layers. Thus, the laydown of silver halide emulsion in the image-forming layers is such that the total silver in those layers is less than 35 mg/dm$^2$. If desired, the silver level can be reduced to less than 30, less than 25 and even less than 20 mg/dm$^2$. Reductions in silver laydown can also be expressed as reductions in the thickness of the film layers and in the thickness of the overall film. Thus, through the use of ultrathin tabular grains, the total thickness of the photographic element exclusive of the support can be reduced to less than 20, 18, and even less than 15 microns.

Turning to the photographic silver halide grains which fall within the description of subparts (2) and (3), the proportion of these type of grains need to be limited to avoid undue scattering of the incident light during image recording. Grains under subpart (2) include both nontabular grains and grains which meet the definition of tabular but which have a thickness of at least 0.10 microns. The content of such grains needs to be limited to preserve the benefits of the invention. Suitably, the content of subpart (2) grains is less than 50 wt. %, desirably less than 25 wt. % and more suitably less than 12 wt. % of the total imaging silver contained in the three subparts.

The grains described for subpart (3) are silver halide tabular grains which have a thickness of from 0.07 microns to less than 0.10 microns. As is the case with the subpart (2) grains, the presence of increasing proportions of subpart (3) grains diminishes the benefits of the invention. Suitably, the content of subpart (3) grains is less than 50 wt. %, desirably less than 40 wt. % and more suitably less than 30 wt. % of the total imaging silver contained in the three subparts.

The photographic element of the invention is particularly advantageous when employed in films designed for higher speeds such as films designated ISO 100 or faster. Such films employ larger grain sizes and tend therefore to raise more granularity concerns.

The imaging process of the invention includes the steps of exposing the photographic element of the invention to light imagewise and then processing the element with a developer to produce a viewable image.

In another aspect of the invention, the photographic element may comprise two or more silver halide emulsion image-forming layers of differing sensitivity to light, at least two of said layers containing ultrathin tabular grains, where for the total of said layers:

(1) ultrathin tabular grains, having a thickness of less than 0.07 microns, comprise at least 25 wt % of the total grain content of subparts (1), (2), and (3);

(2) (a) tabular grains of thickness at least 0.10 microns and (b) non-tabular grains having an ECD of at least 0.15 microns and less than 0.70 microns, comprise not more than 50 wt % of the total grain content of subparts (1), (2), and (3); and (3) tabular grains having a thickness of at least 0.07 microns and a thickness less than 0.10 microns comprise not more than 50 wt % of the total grain content of subparts (1), (2), and (3).

The thin tabular grain emulsions used in this invention could be coated at higher silver levels but the % of the incident light being transmitted per unit of silver laydown decreases due to reflection. The lower transmittance per unit of laydown means that a lower silver laydown must be employed to achieve the same overall transmittance. Quite unexpectedly, however, the decrease in % transmittance was small for increases in thin tabular grain silver laydowns and the specularity of the transmitted light was increased greatly. The undesired reflectance of these thin tabular grain emulsions is coupled with and unexpectedly more than compensated for by the high specularity of the transmitted light. This allows multilayer elements to be constructed, the acutance of which is not degraded by the high internal reflectance because the incident and reflected light retain high specularity. It is this unexpected result that allows multilayer photographic elements of the invention to be constructed using ultrathin tabular grain emulsions that permit reduction in the amount of silver laid down without sacrificing photographic image quality.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps, particularly those useful in conjunction with color reflective prints, are described in *Research Disclosure*, Item 37038, February 1995.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine Literature Ubersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine Literature Ubersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: UK. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography,"

C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

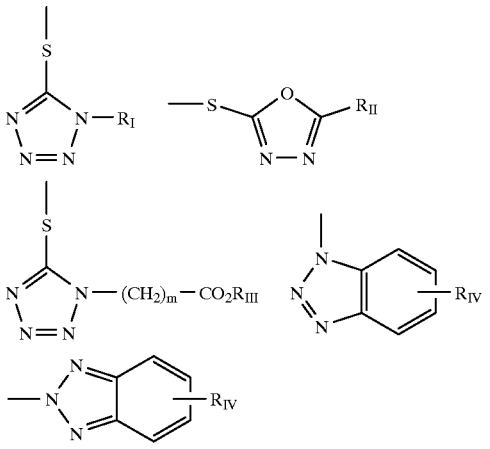

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

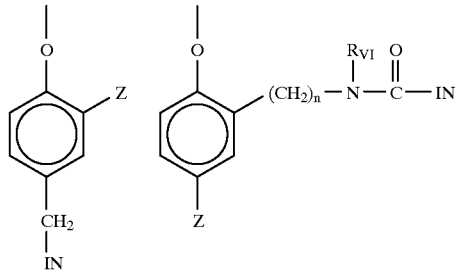

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

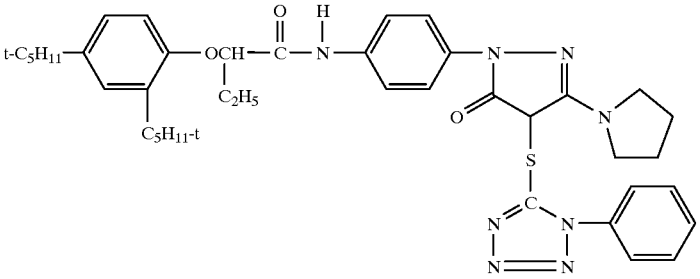

-continued
D2
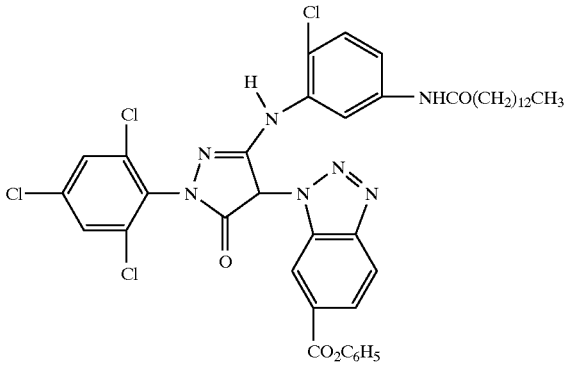
D3
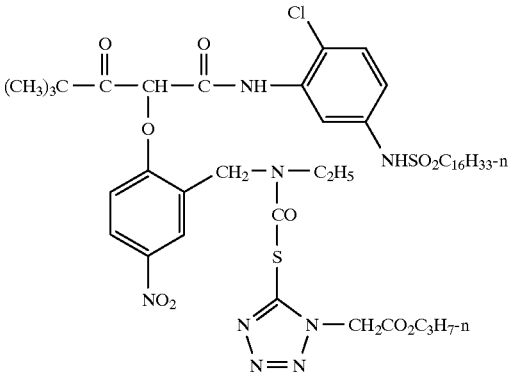
D4
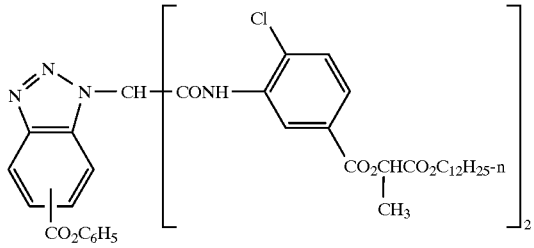
D5
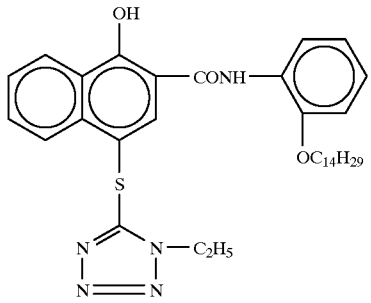

-continued
D6
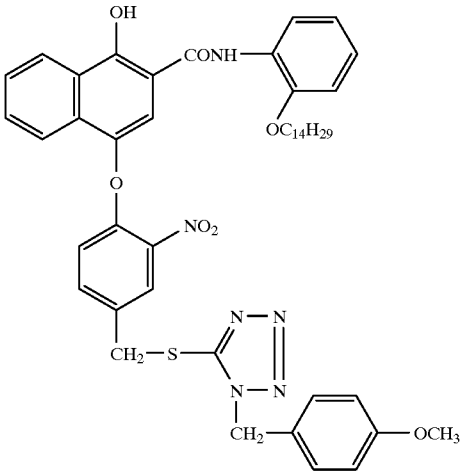
D7
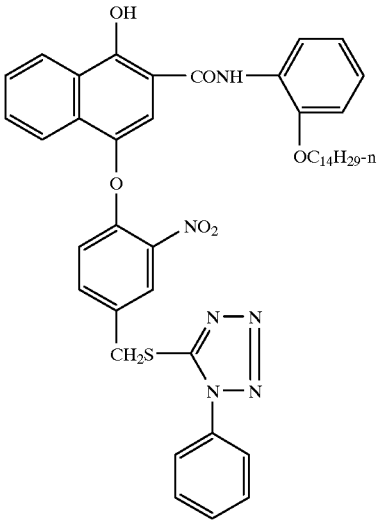
D8
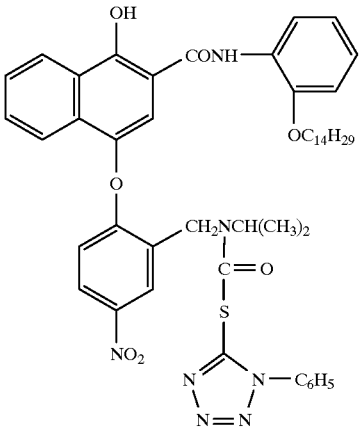

-continued
D9
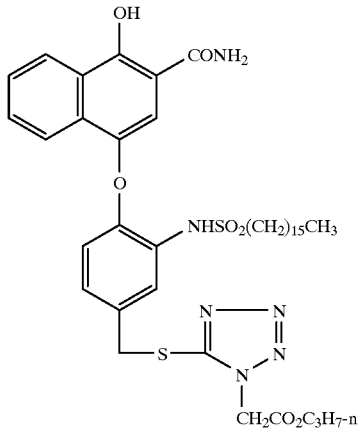
D10
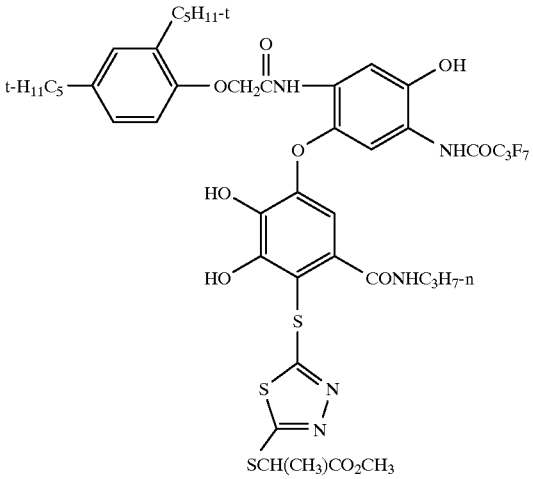
D11
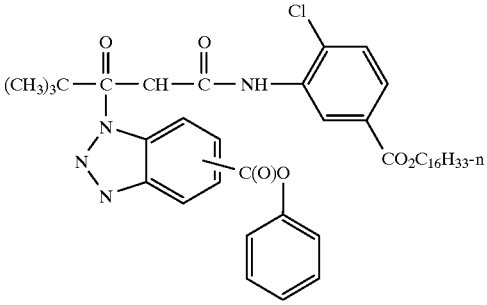
D12
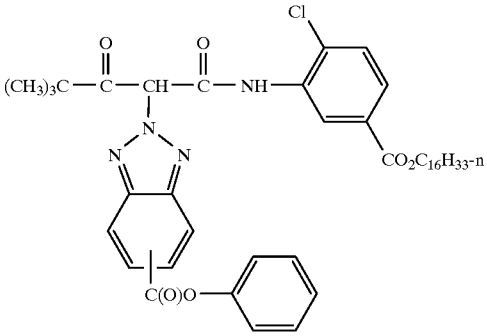

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak C-41 color process as described in the *British Journal of Photography Annual* of 1988, pages 191–198. Where applicable, the element may be processed in accordance with color print processes such as the RA-4 process of Eastman Kodak Company as described in the British Journal of Photography Annual of 1988, Pp 198–199. Such negative working emulsions are typically sold with instructions to process using a color negative method such as the mentioned C-41 or RA-4 process. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as E-6. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the various copending applications as well as patents and other publications cited in this specification are incorporated herein by reference.

I—Emulsion Tests

In the following tests, undyed emulsions are used to determine the optical characteristics of the emulsion using a simple single layer format. The physical characteristics for the emulsions used in this section are described in Table I-1. The samples contain various levels of ultrathin tabular grain content but none represent the invention per se since they are not incorporated in a multicolor element. The emulsions with a "C" designation are relatively low in ultrathin tabular grain content while those with an "E" designation are relatively high in such content. The emulsions are described as follows:

TC-1

This control emulsion was prepared in the same manner as the emulsion of Example 3 of Kofron et al. U.S. Pat. No. 4,439,520. The emulsion was selected as representing a closely related conventional silver bromoiodide tabular grain emulsion in which the tabular grains account for a high percentage of total grain projected area. The 0.12 $\mu$m thickness of the tabular grains clearly distinguishes the emulsion from an emulsion required to satisfy the ultrathin tabular grain emulsion layer requirements in the photographic elements of the invention.

TE-2

This control emulsion was prepared in the same manner as the emulsion of Example 16 of Daubendiek et al., U.S. Pat. No. 4,914,014. The emulsion was selected as representing a conventional silver bromoiodide ultrathin tabular grain emulsion. The tabular grains accounted for 86 percent of total grain projected area.

TE-3, TE-4

These emulsions, both satisfying the emulsion layer requirements of the photographic elements of the invention, were prepared by the same general type of preparation procedure. Emulsion TE-3 contained overall iodide content of 3 mole percent, based on total silver, while TE-4 had an overall iodide content of 3.34 mole percent.

TE-4 was made as follows. A reaction vessel equipped with a stirrer was charged with 3.0 liters of water solution that contained 7.5 g oxidized (low methionine), lime-processed bone gelatin, 20 mMoles NaBr, an antifoamant, and sufficient sulfuric acid to adjust the pH to 1.88. Nucleation was carried out at 35° C. by making a balanced, double-jet addition of 16 mL each 1.25 M silver nitrate and a 1.25 M halide solution that was 94 mole-% NaBr and 6 mole-% KI at a flow rate of 80 mL/min. Following these additions for nucleation, the temperature was raised to 60° C. over a period of 15 minutes. After this temperature adjustment, 100 g oxidized lime-processed bone gelatin in a 500 mL water solution was added to the reactor, the pH was adjusted to 6 with NaOH, and the pBr was adjusted to 1.77 by addition of 40 mL 1 M NaBr. Eighteen minutes after nucleation, growth was begun at the corresponding pAg, by addition of 1.2 M silver nitrate, NaBr, and a suspension of AgI. Silver nitrate flow was initially at 33 mL/min, and it was accelerated at a rate of 0.133 mL/min$^2$ for a period of 30 minutes, then it was accelerated at a rate of 1.9 mL/min$^2$ until delivery of reactant silver nitrate was complete. During this time, the flow of AgI was coupled to that of silver nitrate so that the Ag(Br,I) composition was uniformly 3.33% I, and the flow of sodium bromide was regulated so that the pAg was maintained at the value cited for the start of growth. A total of 3.92 moles of silver halide was precipitated, and the resulting emulsion was washed by the coagulation method.

TE-5, TE-8, TE-9, TE-10, TE-11

These silver bromoiodide emulsions were prepared in a manner similar to the emulsions of TE-3 and 4 described above, but with preparation conditions adjusted to increase tabular grain projected areas to greater than 99% of total grain projected area. Overall iodide content was 3 mole percent, based on silver.

TC-7

This silver bromoiodide control was not taken from any specific teaching in the art, but was prepared to demonstrate the inferior properties of an emulsion having a tabular grain projected area accounting for 99.4% of total grain projected area but failing to satisfy the requirements of the invention by reason of having a thickness not less than 0.07 $\mu$m, specifically 0.12 $\mu$m—i.e., a thickness similar to that of TC-1. The overall iodide content of this control was 3 mole percent, based on silver.

TE-12

This silver bromoiodide control was prepared in the same manner as Emulsion TC-17 in Daubendiek et al. U.S. Pat. No. 4,693,964. This sample was selected to demonstrate the highest average ECD emulsion of Daubendiek et al. It contained an overall iodide content of 3.02 mole percent, based on total silver.

The characteristics of the emulsions are summarized below in Table I-1.

TABLE I-1

| Emulsion | Emulsion Characteristics | | | |
|---|---|---|---|---|
| | ECD (mm) | t (mm) | ECD:t | % TGPA |
| TC-1 | 1.5 | 0.12 | 12:1 | 97.0 |
| TE-2 | 0.73 | 0.036 | 20:1 | 86.0 |
| TE-3 | 1.5 | 0.048 | 31:1 | 99.8 |
| TE-4 | 0.7 | 0.046 | 15:1 | 98.5 |
| TE-5 | 0.88 | 0.034 | 26:1 | 99.3 |

TABLE I-1-continued

| Emulsion | Emulsion Characteristics | | | |
|---|---|---|---|---|
| | ECD (mm) | t (mm) | ECD:t | % TGPA |
| TC-7 | 1.07 | 0.124 | 9:1 | 99.4 |
| TE-8 | 1.51 | 0.034 | 44:1 | 99.6 |
| TE-9 | 1.62 | 0.035 | 46:1 | 99.7 |
| TE-10 | 2.14 | 0.035 | 61:1 | 99.7 |
| TE-11 | 2.27 | 0.037 | 61:1 | 99.7 |
| TE-12 | 0.6 | 0.045 | 13:1 | 99.3 |

The light scattering of coatings of all of the emulsions reported in Table I-1 were measured. All of the emulsions are high aspect tabular grain emulsions. Grain equivalent circular diameters, "ECD"s, were measured on scanning electron micrographs (SEM's). The tabular grain thicknesses, "t", for the emulsions (except TC-1 which was measured by SEM) reported in Table I-1 were determined using a dye adsorption technique. The level of the cyanine dye, 1,1'-diethyl-2,2'-cyanine bromide required for complete saturation of the crystal surfaces was determined. It was assumed that each dye molecule occupied 0.566 nm$^2$ and on this basis the total surface area of the emulsion was determined. Using this area determination and the ECD (determined from SEM's) the expression for surface area was solved for thickness. The high percentage of total grain projected area, "% TGPA", accounted for by tabular grains allowed accurate measurements with this sizing approach.

The single layer emulsions were coated in a range from 0.430 g/m$^2$ silver to 2.15 g/m$^2$ silver on cellulose acetate support. The coatings were prepared at either 1.61 g/m$^2$ gelatin or, for the highest silver levels, 2.69 g/m$^2$ gelatin. A protective topcoat of 1.08 g/m$^2$ gelatin was applied that also contained a hardening agent coated at a level of 1.75% with respect to the total gelatin levels used.

A silver laydown series for each of these emulsions was coated using a single layer format as described above, and the % total transmittance was measured and plotted versus the coated weight of silver halide. Also determined was the % normalized specularity of this transmitted light, and this too was plotted versus the coated weight of silver halide. The amount of silver required to obtain 70% total transmittance was determined for each emulsion and the % normalized specularity of the transmitted light was also determined for this silver laydown. The larger the transmittance percentage, the higher the specularity of the transmitted light, the greater the anticipated advantage in terms of sharpness of the underlying emulsion layers. The findings are given in Table I-2.

TABLE I-2

Silver Levels and Percent Normalized Specular Transmittance at 550 nm and 650 nm for a Total Transmittance of 70%

| | Performance at 650 nm | | | | Performance at 550 nm | | | |
|---|---|---|---|---|---|---|---|---|
| Emulsion | Silver laydown mg/dm$^2$ for 70% transmittance | Silver laydown rel to TC-1 | % Specularity | Specularity rel to TC-1% | Silver laydown mg/dm$^2$ for 70% transmittance | Silver laydown rel to TC-1 | % Specularity | Specularity rel to TC-1% |
| TC-1 | 17.76 | 100.0% | 13.5% | 100.0 | 16.68 | 100.0% | 8.5% | 100.0 |
| TE-2 | 8.88 | 50.0 | 20.0 | 148.1 | 7.10 | 42.6 | 23.5 | 276.5 |
| TE-3 | 7.97 | 44.8 | 54.5 | 403.7 | 5.65 | 33.9 | 56.0 | 658.8 |
| TE-4 | 8.67 | 48.8 | 55.0 | 407.4 | 5.92 | 35.5 | 55.5 | 652.9 |
| TE-5 | 10.01 | 56.4 | 53.5 | 396.3 | 5.60 | 33.5 | 60.5 | 711.9 |
| TC-7 | 16.36 | 92.1 | 14.5 | 107.4 | 20.67 | 123.9 | 5.5 | 64.7 |
| TE-8 | 11.84 | 66.7 | 57.0 | 422.2 | 5.60 | 33.5 | 64.0 | 752.9 |
| TE-9 | 10.55 | 59.4 | 58.5 | 433.3 | 5.33 | 31.9 | 66.0 | 776.5 |
| TE-10 | 9.80 | 55.2 | 62.5 | 463.0 | 4.95 | 29.7 | 70.5 | 829.4 |
| TE-11 | 11.73 | 66.1 | 56.5 | 418.5 | 5.87 | 35.2 | 65.0 | 764.7 |
| TE-12 | 10.76 | 60.6 | 49.0 | 363.0 | 7.21 | 43.2 | 47.0 | 552.9 |

The data in Table II-2 demonstrate that lower coated weights of ultrathin tabular grain emulsions are required to maintain a transmittance of 70% as used in these examples. At 650 nm, emulsions that are greater than 0.04 microns thick (TE-3) require the silver laydown to decrease to 45% of the silver laydown used in the reference emulsion (TC-1). Thinner emulsions (less than 0.04 microns thick) can be coated at higher relative weights (67%, TE-8). The data also demonstrate that the coated weight of small, thin emulsions shows less dependence on the thickness of the emulsion (TE-2, TE-4, TE-5, TE-12). However, the specularity of the transmitted light is somewhat dependent on the %TGPA (see TE-4, TE-5, TE-12% Spec relative to TE-2). Accompanying these changes in silver laydown is a significant improvement in the specularity of the transmitted light relative to the controls. The improvement at 650 nm ranges from 363.0% to 463.0% and at 550 nm from 552.9% to 829.4%.

TC-7 in Table I-2 is a conventional tabular grain emulsion that has a % TGPA like that of the thin tabular grain emulsions. This conventional tabular grain emulsion has more transmittance at 550 nm than at 650 nm as evidenced by the higher silver levels that can be used to obtain 70% transmittance. Increased silver laydowns are often used to improve the granularity of the image. It is clear from the data in this table that this conventional tabular grain emulsion has low % Specularity.

The thin tabular grain emulsions used in this invention could be coated at higher silver levels but the % of the incident light being transmitted per unit of silver laydown decreases due to reflection. The lower transmittance per unit of laydown means that a lower silver laydown must be employed to achieve the same overall transmittance. Quite unexpectedly, however, the decrease in % transmittance was small for increases in thin tabular grain silver laydowns of 16 to 56%, and, as shown by the data in Table I-3, the specularity of the transmitted light was up to 400% of that for the thicker tabular grain control emulsion, TC-1. The undesired reflectance of these thin tabular grain emulsions is coupled with the unexpected observation of high specularity of the transmitted light. This allows multilayer elements to be constructed, the acutance of which is not degraded by the high internal reflectance because the incident and reflected light retain high specularity. It is this unexpected result that allows multilayer photographic elements to be constructed using ultrathin tabular grain emulsions. The imaging silver content of these photographic elements that contain ultrathin tabular grain emulsions can be as high as 108 mg/dm$^2$. One significant opportunity that is made available with the invention is the use of low levels of imaging silver that retain the imaging performance of multilayers prepared with higher levels of imaging silver required by conventional tabular grain emulsions without sacrificing imaging performance as measured by speed, granularity, and acutance.

TABLE I-3

% Transmittance and % Specularity at Higher Silver Laydowns at 650 nm

| | | Performance at Increase Silver Levels | | | | |
|---|---|---|---|---|---|---|
| Emulsion | mg/dm$^2$ for 70% Transmittance | AgX increased to (mg/dm$^2$) | % AgX increase | % Trans-mittance | % Specularity | % Specularity rel to TC-1% |
| TC-1 | 17.76 | | | | | 100.0 |
| TE-2 | 8.88 | 12.91 | 45.3 | 64.5 | 11.0 | 81.5 |
| TE-3 | 7.97 | 12.47 | 56.4 | 65.5 | 40.5 | 300.0 |
| TE-4 | 8.67 | 12.81 | 47.7 | 65.5 | 42.5 | 314.8 |
| TE-5 | 10.01 | 14.85 | 48.3 | 66.0 | 47.5 | 351.9 |

TABLE I-3-continued

| | % Transmittance and % Specularity at Higher Silver Laydowns at 650 nm | | | | | |
|---|---|---|---|---|---|---|
| | | Performance at Increase Silver Levels | | | | |
| Emulsion | mg/dm$^2$ for 70% Transmittance | AgX increased to (mg/dm$^2$) | % AgX increase | % Trans-mittance | % Specularity | % Specularity rel to TC-1% |
| TC-7 | 16.36 | 21.31 | 30.2 | 64.5 | 9.0 | 66.7 |
| TE-8 | 11.84 | 13.78 | 16.3 | 69.0 | 53.5 | 396.3 |
| TE-9 | 10.55 | 13.13 | 24.4 | 69.0 | 52.5 | 388.9 |
| TE-10 | 9.80 | 13.56 | 38.3 | 67.5 | 52.5 | 388.9 |
| TE-11 | 11.73 | 17.22 | 46.8 | 68.0 | 52.5 | 388.9 |
| TE-12 | 10.76 | 13.78 | 28.0 | 66.5 | 40.5 | 300.0 |

Relevant to use in the photographic elements of the invention are tabular grain silver halide emulsions that have thicknesses of 0.07 microns or greater which can be comprised of silver bromide, silver chloride, silver iodide, silver chlorobromide, silver chloroiodide, silver bromoiodide, and silver chlorobromoiodide or mixtures thereof. Such emulsions are disclosed by Wilgus, et al. U.S. Pat. No. 4,434,226; Daubendiek, et al. U.S. Pat. No. 4,414,310; Wey U.S. Pat. No. 4,399,215; Solberg, et al. U.S. Pat. No. 4,433,048; Mignot U.S. Pat. No. 4,386,156; Evans, et al. U.S. Pat. No. 4,504,570; Maskasky U.S. Pat. Nos. 4,435,501 and 4,643,966; and Daubendiek et al. U.S. Pat. Nos. 4,672,027 and 4,693,964. Also specifically contemplated are those silver bromoiodide grains with a higher molar portion of iodide in the core than in the periphery of the grain, such as those described in GB 1,027,146; JA 54/48,521; U.S. Pat. Nos. 4.379,837; 4,444,877; 4,665,614; 4,636,461; EP 264,954. These emulsions are chemically sensitized and spectrally dyed using methods now well known in the art. The physical characteristics of these emulsions, the bulk iodide level, and the spectral sensitizers are given in Tables I-5, -6, and -7.

The ultrathin tabular grain emulsions that are useful in the present invention have thicknesses of less than 0.07 microns and can be comprised of silver bromide, silver chloride, silver iodide, silver chlorobromide, silver chloroiodide, silver bromoiodide, and silver chlorobromoiodide or mixtures thereof. Of particular usefulness are the silver bromoiodides. See the above patents for the preparation of such emulsions.

An example of the procedure used to make and finish the ultrathin emulsions TE-27 through TE-33 described in Table I-5 is as follows:

A series of ultrathin tabular grain emulsions of 1.0 to 3.0 microns by 0.04 to <0.07 microns containing 3 mole % iodide were prepared by running AgI together with $AgNO_3$ and NaBr under carefully controlled conditions of pH, gelatin content and vAg as described in U.S. Pat. No. 5,250,403 was sensitized as described Published EP 94 119 840.0 with 2-butynyl aminobenzoxazole. Chemical sensitizations were performed using 1,3-dicarboxymethyl-1,3-dimethyl-2-thiourea as the sulfur source as described in U.S. Pat. No. 4,810,626 and aurous bis(1,4,5-trimethyl-1,2-4-triazolium-3-thiolate) as the gold source as described in U.S. Pat. No. 5,049,485. The specific sensitization procedure involved the sequential addition to a tabular grain emulsion of sodium thiocyanate, a finish modifier (3-(2-methylsulfamoylethyl)-benzothiazolium tetraflouroborate, a yellow sensitizing dye as noted in Table II-5, the addition of 2-butynyl aminobenzoxazole, followed by the sulfur and gold sensitization. The emulsion was then incubated at 55° C. for 15 min, cooled to 40° C. and 1-(3-acetamidophenyl)-5-mercaptotetrazole was added after the heat incubation.

The make procedure recited above was also used for emulsion TE-31 except that the procedure did not run the AgI. Instead, it incorporated the AgI via a dump step of AgI at 70% of the make.

Emulsions TE-15 and TE-17 can be generally described as banded-I emulsions that contain 1.5 mole % I in the inner 75% of the make and 12 mole % I in the outer 25% of the make. An illustrative example for making this type of emulsion follows.

A vessel equipped with a stirrer was charged with 6 L of water containing 3.75 g lime-processed bone gelatin, 4.12 g NaBr, an antifoamant, and sufficient sulfuric acid to adjust pH to 1.8, at 39° C. During nucleation, which was accomplished by balanced simultaneous 4 sec. addition of AgNO3 and halide (98.5 and 1.5 mole % NaBr and KI, respectively) solutions, both at 2.5 M, in sufficient quantity to form 0.01335 moles of Ag(Br, I), pBr and pH remained approximately at the values initially set in the reactor solution. Following nucleation, the reactor gelatin was quickly oxidized by addition of 128 mg of Oxone ($2KHS0_5.KHSO_4.K_2SO4$ purchased from Aldrich Chemical Co.) in 20 mL $H_2O$, and the temperature was raised to 54° C. in 9 min. After the reactor and contents were held at this temperature for 9 min, 100 g of oxidized lime-processed bone gelatin dissolved in 1.5 L $H_2O$ at 54° C. was added to the reactor. Next the pH was raised to 5.90, and 122.5 mL of 1 M NaBr was added to the reactor. Twenty four and a half minutes after nucleation, the growth stage was begun during which 2.5 M $AgNO_3$, 2.8 M NaBr, and a 0.0503 M suspension of AgI were added in proportions to maintain a uniform iodide level of 1.5 mole % in the growing silver halide crystals, and the reactor pBr at the value resulting from the cited NaBr additions prior to start of nucleation and growth. This pBr was maintained until 0.825 moles of Ag(Br,I) had formed (constant flow rates for 40 min), at which time the excess $Br^-$ concentration was increased by addition of 105 mL of 1 M NaBr; the reactor pBr was maintained at the resulting value for the balance of the growth. Flow rate of $AgNO_3$ was accelerated so that the flow rate at the end of this 53.2 min segment was 10× that at the beginning. After 6.75 moles of emulsion had formed (1.5 mole-% I), the ratio of flows of AgI to $AgNO_3$ was changed such that the remaining portion of the 9 mole batch was 12 mole % I. During formation of this high iodide band, flow rate at the start of this segment, based on rate of total Ag delivered to the reactor, was approximately 25% as great as at the end of the previous segment, and it was accelerated such that the ending flow rate was 1.6 times that at the beginning of this segment. When addition of $AgNO_3$, AgI, and NaBr was complete, the resulting emulsion was washed by ultrafiltration and pH and pBr were adjusted to storage values of 6 and 2.5, respectively.

The resulting emulsion was examined by scanning electron micrography (SEM) and mean grain area was determined using a Summagraphics SummaSketch Plus sizing tablet that was interfaced to a computer: more than 90 number-% of the crystals were tabular, and more than 95% of the projected area was provided by tabular crystals. The mean diameter was 1.98 $\mu$m (coefficient of variation=41). Since this emulsion is almost exclusively tabular, the grain thickness was determined using a dye adsorption technique: The level of 1,1'-diethyl-2,2'-cyanine dye required for saturation coverage was determined, and the equation for surface area was solved for thickness assuming the solution extinction coefficient of this dye to be 77,300 L/mole cm and its site area per molecule to be 0.566 $nm^2$. This approach gave a thickness value of 0.050 $\mu$m.

TE-15 was green sensitized using a finishing procedure that led to the formation of a epitaxial deposit. In this description, all levels are relative to 1 mole of host emulsion. A 5 mole sample of the emulsion was liquified at 40° C. and its pBr was adjusted to ca. 4 with a simultaneous addition of $AgNO_3$ and KI solutions in a ratio such that the small amount of silver halide precipitated during this adjustment was 12% I. Next, 2 mole-% NaCl (based on the original amount of Ag(Br,I) host) was added, followed by addition of sensitizing dyes, after which 6 mole-% Ag(Cl,Br,I) epitaxy was formed by the following sequence of additions: 2.52% $Cl^-$ added as a $CaCl_2$ solution, 2.52% $Br^-$ added as a NaBr solution, 0.000030 moles $K_2Ru(CN)_6$ in a dilute water solution, 0.96% $I^-$ added as a AgI suspension, and 5.04% $AgNO_3$. The post-epitaxy components included 0.75 mg 4,4'-phenyl disulfide diacetanilide, 60 mg NaSCN / mole Ag, 2.52 mg 1,3-dicarboxymethyl-1,3-dimethyl-2-thiourea (disodium salt) (DCT) as sulfur sensitizer, 0.95 mg bis(1,4,5-trimethyl-1,2,4-triazolium-3-thiolate) gold(1) tetrafluoroborate (Au(1)TTT) as gold sensitizer, and 3.99 mg 3-methyl-1,3-benzothiazolium iodide (finish modifier). After all components were added, the mixture was heated to 50° C. for 15 min to complete the sensitization, then 114.4 mg 1-(-3-acetamidophenyl)-5-mercaptotetrazole/mole Ag was added as stabilizer. Finally the sensitized emulsion was chilled and placed in a refrigerator until samples were taken for coatings.

TE-17 was given a similar finish except that it used red sensitizing dyes in place of the green sensitizing dyes, 0.000060 rather than 0.000030 moles $K_2Ru(CN)_6$ was added, 2.9 mg DCT and 0.67 mg Au(1)TTT/mole Ag were used as S and Au sensitizers, and 5.72 mg 1-(-3-acetamidophenyl)-5-mercaptotetrazole/mole Ag was used as finish modifier in place of 3-methyl-1,3-benzothiazolium iodide.

TE-45 and TE-58 used another run iodide/banded iodide host emulsion prepared using a making procedure similar to that described for emulsions TE-15 and TE-17. The conditions were modified to produce slightly thinner grains of the same composition. TE-45 was green sensitized using a sensitization procedure similar to that described for TE-15. TE-58 was red sensitized using a procedure similar to that described for TE-17.

TE-60 is a red sensitized emulsion that was precipitated generally as follows:

Aqueous solutions of 2.38 M $AgNO_3$ and 2.38 M $Na(Br_{095}I_{0.05})$ were introduced at 50° C. over 0.25 minute each at 105.6 mL/min in a double-jet mode into 6.56 L of 0.0048 M NaBr solution containing 3.84 g/L of oxidized methionine lime processed bone gelatin, an antifoamant and sufficient $H_2SO_4$ to adjust the solution pH to a value of 2.0. Following nucleation and after a 14 minute hold period, more oxidized methionine gelatin (70 g) was added in a basic aqueous solution such that the pH increased to 6.0 (at 50° C.) after this addition. Then a solution of 1.0 M NaBr was added subsurface at 19 minutes after nucleation in sufficient amount to decrease the pBr to 1.95. Growth was carried out over 87 min at 50° C. with a stream of AgI (Lippmann) used as the iodide source in conjunction with 2.38 M $AgNO_3$ and 2.38 M NaBr reagents to give a low iodide inner region for accounting for 75 percent of total silver followed by a peripheral region accounting for the final 25 percent of total silver formed by increasing the concentration of iodide introduced to 12 M %, resulting in an average overall iodide content of about 4.5 M %. The first 20.33 minutes of precipitation were carried out with a gradation of the pBr from 1.95 to 1.7. pBr was thereafter maintained constant. After 70 percent of total silver had been introduced and without interrupting the additions of silver and halides $K_2IrCl_6$ was introduced in an aqueous solution in the amount of 0.01 mg per mole of total silver forming the emulsion. The first 59.83 minutes of precipitation (accounting for 75 percent of total silver) was accomplished using a $AgNO_3$ flow rate linear ramp of from 11.0 to 76.8 mL/min. During the last 25 percent of silver introduction the silver nitrate flow rate was ramped from 16.3 to 47.3 mL/min over 27.23 minutes, and the Lippmann addition rate was adjusted to maintain a nominal 12 M % iodide concentration, based on silver. The emulsion was subsequently washed via ultrafiltration, and the pH and pBr were adjusted to storage values of 6.0 and 3.4, respectively.

SEM analysis revealed a mean ECD of 1.29 $\mu$m (COV=60%) and a mean grain thickness of 0.053 $\mu$m. The tabular grains were estimated to account for >95 percent of total grain projected area.

Nominally this is described as a 1.5 mole % run iodide with a 12 mole % iodide-band. The isolated emulsion was red-sensitized. The red sensitizing dyes are noted in Table II-7.

A 1 mole sample of the emulsion was heated to 40° C., and its pBr adjusted to about 4 with a simultaneous addition of $AgNO_3$ and KI (mole ratio 1:0.12). Then 2 M % NaCl based on silver present before the above pBr adjustment was added. Red spectral sensitizing dyes, Dye 1 and Dye 8 were then added in an overall molar concentration of 1.9 mmol/M Ag (molar ratio Dye 1:Dye 8 1:4). Next silver salt epitaxy was deposited in the amount of 6 mole percent, based on the silver forming the tabular grains. This was accomplished by the sequential introduction of $CaCl_2$, NaBr, AgI Lippmann (Cl:Br:I mole ratio 42:42:16) and $AgNO_3$. Each solution was introduced in 3 minutes or less. Observed samples showed epitaxy at most of the tabular grain corners.

The epitaxially sensitized emulsion was next divided into smaller portions with the aim of establishing optimal levels of chemical sensitization. To each sample were added 60 mg/Ag mole NaSCN, Sensitizer 1 as a sulfur sensitizer, Sensitizer 2 as a gold sensitizer, 8 mg/Ag mole APMT and 2.25 mg/Ag mole of bis(p-acetamidophenyl)disulfide. The emulsion with the sensitizers added was heated to 55° C. for 25 minutes. After cooling to 40° C., 114.4 mg of additional APMT was added. From varied levels of Sensitizers 1 and 2 the optimal sensitization was identified and is the basis of the observations below.

TE-59 uses a host emulsion quite similar to TE-60 except that 0.05 mg/mol of $K_2IrCl_6$ is added at the 70% point instead of 0.01 mg/mol and the NaBr added at 19 minutes after nucleation is added as a surface addition. The red-sensitization of this host was like that of TE-60 except that $K_4Ru(CN)_6$ was omitted.

TE-16 uses a host emulsion similar to that of TE-59. The principal changes are:

(i) the inner three-quarters of the grain has a higher iodide concentration of 2.9 mole %-iodide with the outer 25% banding being ca 11 mole %-iodide; and (ii) no iridium dopant is used. The green-sensitization of this host is like the red sensitization with the exception that spectral sensitizing dyes cited in Table II-6 were added at 2.0 mmol/Ag. No ruthenium is used in this sensitization example.

TE-46 was precipitated like TE-16 except that the run iodide portion of the make was eliminated to thereby prepare a host emulsion generally described as a 0 mole % iodide run with an outer 12 mole % iodide band. The emulsion was green spectrally sensitized following similar procedures already reviewed. There are no Ir or Ru dopants in this example.

TE-47 used an iridium-doped host emulsion generally described as having a 3 mole %-run iodide inner three-quarter core in place of 1.5 mole % iodide. The 6 mole % epitaxy composed of 42:42:16 (Cl:Br:I) nominal halide mole ratios contains 0.0075 m % $K_4Ru(CN)_6$ and used $CaCl_2$ and AgI as Cl and I sources respectively for the epitaxy. The notable other differences are in the heating step at 55° C. for 15 minutes and the lack of use of bis(p-acetamido-phenyl) disulfide.

Emulsions like those cited above were used to determine the spectral absorption for the thin tabular grain emulsions relative to conventional thicker tabular grain emulsions. These data were obtained using a single layer format at a single silver laydown of 8.89 mg/dm$^2$. The absorptance of each emulsion was measured as a function of wavelength, and then this absorptance was integrated with the spectral response curve of either a KODAK WRATTEN 9 filter for green-sensitive emulsions or a KODAK WRATTEN 23a filter for red sensitized emulsions. The base 10 logarithm of the obtained value is a measure of the expected emulsion speed derived from optics alone. The difference between this optical speed of the test emulsion and that of the reference emulsion is then determined and ratioed to 0.30, a one stop increment in speed. The emulsion description and results from this analysis are given in Table I-4. It is clear from this data that the thin tabular grain emulsions absorb more light at constant silver than the thicker tabular grain emulsions.

TABLE I-4

Impact on Optical Speed of High Sensitizing Dye Load available with Thin Tabular Grain Emulsions

| Emulsion ID | ECD (microns) | Thickness (microns) | Integrating WR Filter | Log Absorption | % Speed Change Rel. to Green | % Speed Change Rel. to Red |
|---|---|---|---|---|---|---|
| T-13 | 1.68 | 0.127 | WR-9 | 2.964 | ref | |
| T-14 | 2.20 | 0.131 | WR-23a | 3.156 | | ref |
| TE-15 | 1.98 | 0.050 | WR-9 | 3.112 | 49.3% | |
| TE-16 | 1.17 | 0.054 | WR-9 | 3.201 | 79.0% | |
| TE-17 | 1.98 | 0.050 | WR-23a | 3.328 | | 57.3% |

TABLE I-5

Blue sensitized emulsions

| Emulsion ID | Mole % Iodide | ECD (microns) | Thickness (microns) | SD-1 (mmoles/mole) | SD-2 (mmoles/mole) |
|---|---|---|---|---|---|
| TC-18 | 9.0 | 0.78 | non-tabular | 0.313 | |
| TC-19 | 4.1 | 2.23 | 0.14 | 0.880 | |
| TC-20 | 7.4 | 1.11 | 0.20 | 0.550 | |
| TC-21 | 3.0 | 0.531 | non-tabular | 0.550 | |
| TC-22 | 3.0 | 0.636 | 0.345 | 0.550 | |
| TC-23 | 3.0 | 0.506 | 0.256 | 0.620 | |
| TC-24 | 1.3 | 0.38 | 0.08 | 1.161 | |
| TC-25 | 1.5 | 0.37 | 0.08 | 1.160 | |
| TC-26 | 1.3 | 0.38 | 0.084 | 1.160 | |
| TE-27 | 2.7 | 3.136 | 0.077 | 0.625 | 0.625 |
| TE-28 | 2.46 | 2.41 | 0.065 | 1.20 | |
| TE-29 | 2.7 | 2.057 | 0.058 | 0.90 | 0.90 |
| TE-30 | 2.7 | 1.319 | 0.047 | 1.10 | 1.10 |
| TE-31 | 1.40 | 0.458 | 0.042 | 1.20 | 1.20 |
| TE-32 | 2.46 | 1.94 | 0.05 | 1.60 | |
| TE-33 | 2.46 | 1.19 | 0.05 | 2.20 | |

TABLE I-6

Green sensitized emulsions

| Emulsion ID | Mole % Iodide | ECD (μm) | t (μm) | SD-3 (mmoles/mole) | SD-4 (mmoles/mole) | SD-5 (mmoles/mole) | SD-6 (mmoles/mole) |
|---|---|---|---|---|---|---|---|
| TC-34 | 3.0 | 1.61 | 0.12 | 0.657 | | | 0.214 |
| TC-35 | 4.1 | 1.01 | 0.13 | 0.619 | 0.213 | | |
| TC-13 | 4.1 | 1.30 | 0.13 | 0.626 | 0.216 | | |
| TC-36 | 3.0 | 1.11 | 0.12 | 0.740 | | | 0.237 |
| TC-37 | 4.1 | 0.91 | 0.11 | 0.650 | 0.213 | | |
| TC-38 | 4.1 | 0.92 | 0.11 | 0.659 | 0.215 | | |
| TC-39 | 2.0 | 0.75 | 0.10 | 0.657 | | | 0.214 |
| TC-40 | 4.1 | 0.65 | 0.091 | 0.659 | 0.215 | | |
| TC-41 | 1.5 | 0.38 | 0.084 | 0.659 | 0.215 | | |
| TC-42 | 1.3 | 0.38 | 0.08 | 0.657 | | | 0.214 |
| TC-43 | 1.5 | 0.34 | 0.09 | 0.657 | | | 0.214 |
| TC-44 | 1.3 | 0.38 | 0.084 | 0.656 | 0.215 | | |
| TE-15 | 4.125 | 1.75 | 0.063 | 1.17 | 0.390 | | |
| TE-45 | 4.1 | 1.76 | 0.05 | 1.61 | | 0.210 | |
| TE-16 | 4.9 | 0.861 | 0.054 | 1.71 | 0.290 | | |
| TE-46 | 3.01 | 1.158 | 0.049 | 1.54 | 0.260 | | |
| TE-47 | 5.3 | 0.807 | 0.50 | 1.543 | | 0.258 | |

TABLE I-7

Red sensitized emulsions

| Emulsion ID | Mole % Iodide | ECD (μm) | t (μm) | SD-7 (mmoles/mole) | SD-8 (mmoles/mole) | SD-9 (mmoles/mole) | SD-10 (mmoles/mole) |
|---|---|---|---|---|---|---|---|
| TC-48 | 3.0 | 2.33 | 0.13 | 0.099 | 0.861 | | |
| TC-49 | 3.0 | 1.40 | 0.12 | 0.077 | 0.919 | | |
| TC-14 | 4.1 | 1.99 | 0.13 | 0.098 | 0.849 | | |
| TC-50 | 3.0 | 0.78 | 0.12 | 0.080 | 0.919 | | |
| TC-51 | 4.1 | 0.97 | 0.12 | 0.098 | 0.856 | | |
| TC-52 | 4.1 | 0.54 | 0.12 | | 1.083 | | 0.118 |
| TC-53 | 4.1 | 0.72 | 0.12 | 0.114 | 1.023 | | |
| TC-54 | 1.5 | 0.43 | 0.12 | 0.100 | 0.900 | | |
| TC-55 | 1.5 | 0.38 | 0.084 | 0.077 | 0.920 | | |
| TC-56 | 1.3 | 0.38 | 0.08 | 0.077 | 0.923 | | |
| TC-57 | 1.3 | 0.38 | 0.084 | | 0.960 | | 0.106 |
| TE-17 | 4.125 | 1.75 | 0.063 | 0.346 | | 1.240 | |
| TE-58 | 4.1 | 1.76 | 0.05 | 0.290 | | 1.330 | |
| TE-59 | 4.9 | 0.861 | 0.055 | 0.380 | | 1.520 | |
| TE-60 | 4.1 | 0.937 | 0.054 | 0.380 | | 1.520 | |

II. Multilayer Photographic Elements of the Invention

Several multilayers were constructed, except as indicated otherwise, on the following layer order.

Support

Layer 1 (AHU - AntiHalation Unit)

Layer 2 (Interlayer)

Layer 3 (Slow Cyan Imaging Layer)

Layer 4 (Fast Cyan Imaging Layer)

Layer 5 (Interlayer)

Layer 6 (Slow Magenta Imaging Layer)

Layer 7 (Mid Magenta Imaging Layer)

Layer 8 (Fast Magenta Imaging Layer)

Layer 9 (Yellow Filter Layer)

Layer 10 (Slow Yellow Imaging Layer)

Layer 11 (Fast Yellow Imaging Layer)

Layer 12 (UV Ultraviolet Protection Layer)

Layer 13 (Protective Overcoat)

The precise make-up of each sample and the formulas for the compounds employed is provided following the discussion of the results. The values for the ISO speed, MTF accutance, and graininess were obtained as follows:

Table II summarizes the results from multilayer testing.

The speed of the coatings was determined by exposing the coatings to white light at 5500 K using a carefully calibrated graduated density test object. Exposure time was 0.02 sec. The exposed coating was then developed for 195 sec at 38C using the known C-41 color process as described, for example, in *The British Journal of Photographic Annual* 1988, pp 196–198. The developed silver was removed in the 240 sec bleaching treatment, washed for 180 sec, and the residual silver salts were removed from the coating by a treatment 240 sec in the fixing bath. The Status M densities of the processed strips are read and used to generate a characteristic curve (Density versus Log H). The ISO speed is then calculated using equations described in ISO 5800-1979(E).

The granularity of these multilayer elements was determined from coating that were exposed through a graduated density test object to white light at 5500 K. The exposure time was 0.02 sec. The exposed coatings were processed using the C41 Process already described. The granularity of the image dye scale was obtained by measuring the fluctuations in the density of a uniform density patch with a 48 micron scanning aperture. The root mean square of these density fluctuations was obtained. The reference sample was normalized to a granularity of 1.00. Samples that have lower granularity than the reference have ratios relative to the reference that is less than 1.00.

The Modulation Transfer Functions were obtained using the procedure described in *Journal of Applied Photographic Engineering,* 6,1 (1980). Test coatings were given sinusoidal exposures of 1/8 sec at 0% modulation using a color corrected (60 cc Blue and 20 cc Red) tungsten lamp. Exposed coatings were then processed using the C-41 Process already described. Measurements were obtained as described in the cited reference. The reference sample was normalized to an acutance value of 100. Samples that had higher acutance than the reference sample had ratios greater than 100 in Table II.

TABLE II

Summary of Multilayer Results

| Coating | Image Silver (mg/dm$^2$) | ISO Speed | Norm. Red MTF | Norm. Green MTF | Norm. Red Grain | Norm. Green Grain | % Imaging Silver in Subpart 1 | 2 | 3 |
|---|---|---|---|---|---|---|---|---|---|
| Ex A Comp | 60.31 | 349 | 103 | 103 | 1.00 | 1.00 | 0.0 | 75.0 | 25.0 |
| Ex B | 41.31 | 263 | 100 | 100 | 0.857 | 0.835 | 0.0 | 73.1 | 26.9 |

TABLE II-continued

| Summary of Multilayer Results | | | | | | | | | |
|---|---|---|---|---|---|---|---|---|---|
| | Image Silver | ISO | Norm. Red | Norm. Green | Norm. Red | Norm. Green | % Imaging Silver in Subpart | | |
| Coating | (mg/dm$^2$) | Speed | MTF | MTF | Grain | Grain | 1 | 2 | 3 |
| Comp Ex C | 37.26 | 347 | 102 | 101 | 0.925 | 1.060 | 0.0 | 84.5 | 15.5 |
| Comp Ex D | 33.48 | 378 | 103 | 102 | 0.795 | 0.858 | 67.9 | 0.0 | 32.1 |
| Inv Ex E | 33.48 | 407 | 101 | 100 | 0.891 | 1.00 | 67.9 | 0.0 | 32.1 |
| Inv Ex F | 21.11 | 336 | 105 | 103 | 0.849 | 0.953 | 67.7 | 0.0 | 32.9 |
| Inv Ex G | 21.11 | 369 | 103 | 101 | 0.924 | 1.10 | 67.3 | 0.0 | 32.7 |
| Inv Ex H | 25.67 | 381 | 103 | 101 | 0.827 | 0.937 | 67.0 | 0.0 | 37.8 |
| Inv Ex I | 18.04 | 355 | 103 | 101 | 0.975 | 1.197 | 62.2 | 0.0 | 37.8 |
| Inv Ex J | 18.04 | 363 | 102 | 100 | 1.00 | 1.228 | 62.2 | 0.0 | 37.8 |
| Inv Ex K | 18.04 | 358 | 103 | 100 | 0.975 | 1.047 | 62.2 | 0.0 | 37.8 |
| Inv Ex L | 21.11 | 386 | 103 | 100 | 0.933 | 0.898 | 67.3 | 0.0 | 32.7 |
| Inv Ex M | 25.67 | 391 | 103 | 101 | 0.849 | 0.850 | 67.0 | 0.0 | 37.8 |
| Inv Ex N | 22.22 | 243 | 104 | 100 | 0.824 | 0.905 | 73.0 | 10.1 | 18.2 |
| Inv Ex O | 23.30 | 253 | 104 | 100 | 0.857 | 0.964 | 59.6 | 15.2 | 25.2 |
| Inv Ex P | 26.63 | 344 | 101 | 101 | 1.022 | 1.186 | 0.0 | 83.4 | 16.6 |
| Comp | | | | | | | | | |

The multilayer results may be analyzed as follows:

EXAMPLE A (Comparative Example)

Represents a high speed color negative format that uses thick tabular grain emulsions. The total imaging silver is 60.31 mg/dm$^2$. The data from the previous tests would indicate that thin tabular grain emulsions should be coated in laydowns ranging from as low as 30% to as high as 67% of that employed using this thick tabular grain comparison example, depending on both their exact thickness and the spectral region (red or green). If we apply this simple percentage to the coated level of imaging silver as found in Example A, we would expect to coat the thin tabular grain emulsions at levels as low as 18.09 mg/dm$^2$ to as high as 40.41 mg/dm$^2$ in order to obtain equivalent transmittance.

EXAMPLE B (Comparative Example)

Represents a second high speed color negative format that uses thick tabular grain emulsions. The total imaging silver is 41.31 mg/dm$^2$. This example is used as a low silver reference that features conventional thick tabular grain emulsions in a multilayer format that attempts to lower the total silver laydown. The key features of this example are the loss in speed (263 vs 349 for Example A) and the lower acutance relative to Example A, accompanied by improved granularity relative to Example A.

EXAMPLE C (Comparative Example)

Represents a third high speed color negative format that uses thick tabular grain emulsions at an imaging silver level above that of the present invention. The total imaging silver is 37.26 mg/dm$^2$. This example is used as a reference that features conventional thick tabular grain emulsions in a multilayer format at silver levels above the highest levels of thin tabular grain emulsions in accordance with the invention. The key features of this example are the match in speed relative to Comparative example A. There is a decrease in acutance accompanied by a 6% degradation in the measured value of the green rms granularity. The red rms granularity continues to be advantaged in this format by 7.5% relative to Comparative Ex A.

EXAMPLE D (Invention)

Represents a high speed color negative format that uses ultrathin tabular grain emulsions at a total imaging silver level of 33.48 mg/dm$^2$ like that used in Comparative Example C. The key features of this example are the increased speed relative to Comparative Examples A and C with acutance like that of these two comparative examples at significantly lower granularity than either Example A or C. The red granularity advantage is also evident versus Comparative Example B even though the acutance in Example D is superior and obtained at significantly higher speed. This is quite unexpected in that we would have expected the granularity to deteriorate since it is well-known that as the coated silver level is decreased and the number of silver development centers is decreased, the granularity worsens. The high speed in this example is unexpected because it would have been expected from the art that the projected area of the grains in the emulsions used in this example would have to be enlarged to accommodate the speed losses expected from the high reflectance of the thin grain emulsions and that this would further deteriorate the granularity of the multilayer. Further, the high reflectance would be expected to adversely affect acutance, yet the invention shows that the acutance is at parity with that obtained in Comparative Examples A and C.

EXAMPLE E (Invention)

Represents a high speed color negative format that uses thin tabular grain emulsions at an imaging silver level (33.48 mg/dm$^2$) like that used in Example D but features a lower level of image modifiers in the three color records. The impact of these changes is to further increase the photographic speed of this example while retaining acutance parity with respect to Comparative Example B and granularity parity with respect to Comparative example A. These observations indicate that the image modifying chemistry of this Example offers some improvements in the overall acutance of this example relative to Example A. The changes in acutance are small relative to change expected if the high internal reflectances of the multilayer were to lead to degradation of the acutance. Such potential catastrophic failure caused by the internal reflectances could only be hoped to be corrected using high levels of incorporated image modifying chemistry. We would therefore expect that reductions in the incorporated image modifying chemistry would lead to substantive losses in acutance. This phenomenon is surprisingly not observed.

EXAMPLE F (Invention)

Represents a high speed color negative format that uses thin tabular grain emulsions at imaging silver levels of 21.11 mg/dm$^2$ (35% of Comparative Example A), significantly lower than used in any conventional color negative film processed through contemporary Kodak Flexicolor® C-41 Color Negative processing. This Example is prepared like Example D in that high levels of image modifying chemicals are used. The speed of this photographic element is between that of Comparative examples A and C while retaining significant granularity and acutance advantages relative to these comparative examples.

EXAMPLE G (Invention)

Is like Example E but uses the significantly lower imaging silver levels of Example F. The data illustrates a speed increase is obtained versus Example F. A slight acutance advantage is obtained relative to Example E. Example G has performance like that of Comparative Example C, a multilayer coating using 76% higher levels of coated silver.

EXAMPLE H (Invention)

Uses an intermediate level of thin tabular grain emulsions for the imaging silver (25.67 mg/dm$^2$). The speed of this example is greater than Comparative Example A, and the granularity of this example is significantly less than Comparative Example A at matched red acutance and slightly inferior green acutance. This example uses 42.5% of the silver used in Comparative Example A. Overall imaging performance (speed, granularity, and acutance) remain strongly advantaged versus the all thick tabular grain low silver Comparative Example C. The data supports that acutance can be retained at higher silver levels than predicted from the % Transmittance and that the expected speed losses associated with high reflectance of thin tabular grain emulsions are not realized.

EXAMPLE I (Invention)

Uses thin tabular grain emulsions at a very low level of total imaging silver (18.04 mg/dm$^2$). This example also includes a design feature that was first suggested by the early conventional tabular grain emulsion patents but that was never commercially used and that is the removal of yellow filter dye material from the layer located between the fast magenta emulsion-containing layer and the slow yellow emulsion-containing layer. This very low silver format maintains speed relative to Comparative examples A and C. It retains comparable red and green acutance as these comparative examples. This example continues to show a red granularity advantage versus Comparative Example A.

EXAMPLE J (Invention)

Uses slightly less yellow image modifier at the silver levels of Example I. The change moves the red granularity to parity with the check position, Comparative example A, but at a higher multilayer speed. The silver laydown of Example J is 29.9% of the imaging silver used in Comparative Example A.

EXAMPLE K (Invention)

Uses a different blend of image modifiers at the silver levels of Example I. This example shows that the very low level of coated image silver (29.9% of the imaging silver used in Comparative Example A) can be utilized in a color negative format processed via the Standard C-41 Process to render imaging performance at near parity to the Comparative Example A. Thus this invention which utilizes the thin tabular grain emulsions is capable of more efficient utilization of silver (speed, acutance, and granularity) than is obtained with thicker tabular grain emulsions.

EXAMPLE L (Invention)

Slightly increases the total imaging silver of thin tabular grain emulsions from that used in Examples I, J, and K to 21.1 mg/dm$^2$ (+17% versus these examples) to obtain speed that is faster than that of Example G (which uses the same amount of total ultrathin tabular grain emulsions for imaging silver but different image modifiers) with significant improvement in green granularity. This invention shows that the relative speed improvement obtained by lowering the image modifier package as in Examples E and G need not be accompanied by a degradation in green granularity as suggested by these same examples.

EXAMPLE M (Invention)

Builds off the teaching in Example L and demonstrates that the silver laydowns of the thin tabular grain emulsions can be increased above the level expected for matched transmittance relative to thicker conventional tabular grain emulsions without loss of acutance, thus allowing for continued reduction in the granularity of the invention.

EXAMPLE N (Invention)

Describes a multilayer composition that gives speed slightly less than Comparative example B at 53.7% of the total imaging silver used in Comparative Example B. This is accomplished with improved acutance and granularity in the red record, with parity in acutance for the green record and 7% degradation in the green record's granularity.

EXAMPLE O (Invention)

Describes a multilayer composition that gives speed slightly less than Comparative Example B at 56.4% of the total imaging silver used in Comparative Example B. This is accomplished with improved acutance and granularity in the red record, with parity in acutance for the green record.

EXAMPLE P (Comparative)

Describes a multilayer composition that uses all Group 2 or 3 emulsion grains at levels of imaging silver that corresponds to those used for the Examples of this invention. The total imaging silver level is 26.63 mg/dm$^2$. The speed of this example is comparable to that of Example F (Invention) and Example C (Comparative). The red and green acutance of Example P is at parity with Example C but inferior to Example F. The normalized red and green granularity is significantly degraded relative to both Example C (Comparative) and Example F (Invention). Example K (Invention), at 67.7% of the imaging silver used in Example P (Comparative) is still superior to this low silver comparative example that uses tabular grain emulsions at least as thick as 0.07 microns.

The data show that low silver films built with ultrathin tabular grain emulsions can achieve ISO speeds greater than the comparison checks without deterioration in acutance (normalized acutance for red/green 0 to 3% greater with invention) at matched or lower relative granularity as measured at a normal exposure (lower percentage vs comparison is better). Performance parity to a comparison example can be obtained at lower levels of coated image silver than the comparison example.

The examples presented demonstrate that emulsions containing ultrathin tabular grains which have inherent high reflectivity can be used in so-called successive layer structures that are widely used in color photographic materials without degradation of optical acutance or loss in speed of underlying emulsion layers. Transmission of the necessary amount of light into the multilayer element is achieved by reducing the coated weight of imaging silver halide. We have also unexpectedly learned that the amount of transmitted light can increase for a given coated weight of silver halide as the thickness continues to decrease below 0.07 microns thick. This is confirmed for thicknesses less than 0.03 microns thick. We have further learned that actinic light, once transmitted into the multilayer, must have a high probability for spectral absorption. This implies that the cited emulsions have high loads of sensitizing dye per grain so that the incident light is effectively absorbed in the desired layer. The high surface area per mole of thin tabular grain emulsions allows for increased absorption of the incident light at low silver laydowns. Among the advantages that had been unexpected from this management of transmitted light for thin tabular grain emulsions are:

a) a decrease in the total silver laydown for equivalent multilayer transmittance, b) maintenance of the spectral speed of the emulsions because of their high levels of sensitizing dye per unit coated weight of silver, c) increased optical acuity of the transmitted light, d) maintenance of excellent signal-to-noise response for the photographic element, e) a decrease in the environmental impact of the photographic element due to lowered concentrations of chemicals in the processed film, f) thinner layer structures.

Multilayer Descriptions

In the following multilayer descriptions, "Lippmann" refers to an unsensitized fine grain silver bromide emulsion of 0.05 micron diameter, and "BVSM" refers to bis-(vinylsulfonyl) methane.

EXAMPLE A (Comparative) 60.31 mg/dm$^2$

| | | |
|---|---|---|
| Layer 1 | 24.22 mg/dm$^2$ | gelatin |
| | 1.40 | black filamentary silver |
| | 1.61 | Dox scavenger (OxDS-1) |
| | 0.32 | UV absorber (Dye-1) |
| | 0.75 | UV absorber (Dye-2) |
| | 0.14 | yellow tint (Dye-3) |
| | 0.13 | cyan pre-formed dye (Dye-4) |
| | 0.52 | magenta pre-formed dye (Dye-5) |
| | 0.85 | yellow-colored magenta dye former (Dye-12) |
| | 0.10 | soluble red filter dye (Dye-6) |
| Layer 2: | omit | |
| Layer 3: | 26.95 mg/dm$^2$ | gelatin |
| | 8.00 | slow cyan silver TC-56 |
| | 7.39 | mid-cyan silver TC-49 |
| | 4.52 | cyan dye former (C-1) |
| | 0.54 | cyan dye forming bleach accelerator (B-1) |
| | 0.48 | cyan dye forming image modifier (DIR-1) |
| Layer 4: | 18.23 mg/dm$^2$ | gelatin |
| | 10.76 | fast cyan silver TC-48 |
| | 1.50 | cyan dye former (C-1) |
| | 0.38 | cyan dye forming image modifier (DIR-1) |
| | 0.43 | magenta colored cyan dye forming masking coupler (MC-1) |
| Layer 5: | 12.92 mg/dm$^2$ | gelatin |
| Layer 6: | 21.21 mg/dm$^2$ | gelatin |
| | 5.69 | slow-slow magenta silver TC-42 |
| | 4.77 | slow magenta silver TC-39 |
| | 3.23 | mid-magenta silver TC-36 |
| | 1.69 | fast magenta silver TC-34 |
| | 1.94 | magenta dye forming coupler (M-1) |
| | 1.83 | yellow colored magenta dye forming masking coupler (MC-2) |
| | 0.16 | magenta image modifier (DIR-2) |
| | 0.03 | cyan dye forming bleach accelerator (B-1) |
| | 0.11 | soluble green filter dye (Dye-7) |
| Layer 7: | omit | |
| Layer 8: | 16.17 mg/dm$^2$ | gelatin |
| | 8.07 | fast magenta silver TC-34 |
| | 1.00 | magenta dye forming coupler (M-1) |
| | 0.22 | magenta image modifier (DIR-2) |
| | 0.01 | cyan dye forming bleach accelerator (B-1) |
| Layer 9: | 8.61 mg/dm$^2$ | gelatin |
| | 0.54 | yellow colloidal silver |
| | 0.54 | Dox scavenger (OxDS-1) |
| Layer 10: | 21.32 mg/dm$^2$ | gelatin |
| | 1.39 | slow yellow silver TC-24 |
| | 3.40 | mid-yellow silver TC-21 |
| | 1.94 | yellow dye forming coupler (Y-1) |
| | 8.61 | yellow dye forming coupler (Y-2) |
| | 0.64 | yellow dye forming image modifier (DIR-3) |
| | 0.09 | soluble red filter dye (Dye-6) |
| Layer 11: | 12.92 mg/dm$^2$ | gelatin |
| | 5.92 | fast yellow silver T-18 |
| | 3.82 | yellow dye forming coupler (Y-1) |
| | 2.15 | yellow dye forming coupler (Y-2) |
| | 0.75 | yellow dye forming image modifier (DIR-3) |
| | 0.08 | cyan dye forming bleach accelerator (B-1) |
| | 0.44 | soluble blue filter dye (Dye-9) |
| Layer 12: | 6.99 mg/dm$^2$ | gelatin |
| | 2.15 | Lippmann silver |
| | 1.08 | UV absorber (Dye-1) |
| | 1.08 | UV absorber (Dye-2) |

-continued

| | | |
|---|---|---|
| Layer 13: | 8.88 mg/dm$^2$ | gelatin |
| | 1.07 | soluble matte beads |
| | 0.05 | permanent matte beads |
| | lubricants | |
| | 1.60% BVSM | |
| | 4.9% | |
| | Glycerin | |

EXAMPLE B (Comparative) 41.31 mg/dm$^2$

| | | |
|---|---|---|
| Layer 1: | 21.53 mg/dm$^2$ | gelatin |
| | 1.51 | black filamentary silver |
| | 1.61 | Dox scavenger (OxDS-1) |
| | 0.32 | UV absorber (Dye-1) |
| | 0.75 | UV absorber (Dye-2) |
| | 0.28 | cyan pre-formed dye (Dye-4) |
| | 0.38 | magenta pre-formed dye (Dye-5) |
| | 1.94 | yellow -colored magenta dye former (Dye-12) |
| Layer 2: | omit | |
| Layer 3: | 20.45 mg/dm$^2$ | gelatin |
| | 4.50 | slow cyan silver TC-56 |
| | 3.25 | mid-cyan silver TC-50 |
| | 4.09 | cyan dye former (C-1) |
| | 0.54 | cyan dye forming bleach accelerator (B-1) |
| | 0.32 | cyan dye forming image modifier (DIR-1) |
| Layer 4: | 10.76 mg/dm$^2$ | gelatin |
| | 7.00 | fast cyan silver TC-49 |
| | 1.10 | cyan dye former (C-1) |
| | 0.24 | cyan dye forming image modifier (DIR-1) |
| | 0.22 | magenta colored cyan dye forming masking coupler (MC-1) |
| Layer 5: | 12.92 mg/dm$^2$ | gelatin |
| Layer 6: | 16.19 mg/dm$^2$ | gelatin |
| | 2.45 | slow-slow magenta silver TC-43 |
| | 2.45 | slow magenta silver TC-40 |
| | 4.91 | magenta dye forming coupler (M-2) |
| Layer 7: | 16.15 mg/dm$^2$ | gelatin |
| | 6.24 | mid magenta silver TC-37 |
| | 1.23 | magenta dye forming coupler (M-2) |
| | 0.64 | yellow colored magenta dye forming masking coupler (MC-2 |
| | 0.32 | magenta image modifier (DIR-2) |
| | 0.03 | cyan dye forming bleach accelerator (B-1) |
| Layer 8: | 12.91 mg/dm$^2$ | gelatin |
| | 5.38 | fast magenta silver TC-35 |
| | 0.52 | magenta dye forming coupler (M-2) |
| | 0.16 | magenta image modifier (DIR-2) |
| | 0.01 | cyan dye forming bleach accelerator (B-1) |
| Layer 9: | 8.61 mg/dm$^2$ | gelatin |
| | 0.59 | yellow colloidal silver |
| | 0.54 | Dox scavenger (OxDS-1) |
| Layer 10: | 17.34 mg/dm$^2$ | gelatin |
| | 1.72 | slow yellow silver TC-24 |
| | 2.47 | mid-yellow silver TC-21 |
| | 6.46 | yellow dye forming coupler (Y-3) |
| | 0.11 | yellow dye forming image modifier (DIR-3) |
| Layer 11: | 9.15 mg/dm$^2$ | gelatin |
| | 5.85 | fast yellow silver TC-18 |
| | 2.69 | yellow dye forming coupler (Y-1) |
| | 2.15 | yellow dye forming coupler (Y-3) |
| | 0.21 | yellow dye forming image modifier (DIR-3) |
| | 0.08 | cyan dye forming bleach accelerator (B-1) |
| Layer 12: | 6.99 mg/dm$^2$ | gelatin |
| | 2.15 | Lippmann silver |
| | 1.08 | UV absorber (Dye-1) |
| | 1.08 | UV absorber (Dye-2) |

-continued

| | | |
|---|---|---|
| Layer 13: | 8.88 mg/dm$^2$ | gelatin |
| | 1.07 | soluble matte beads |
| | 0.05 | permanent matte beads |
| | lubricants | |
| | 1.60% BVSM | |
| | 4.9% | |
| | glycerin | |

Comparative Example C 37.26 mg/dm$^2$

| | | |
|---|---|---|
| Layer 1: | 21.53 mg/dm$^2$ | gelatin |
| | 1.51 | black filamentary silver |
| | 1.61 | Dox scavenger (OxDS-2) |
| | 0.32 | UV absorber (Dye-1) |
| | 0.75 | UV absorber (Dye-2) |
| | 0.07 | cyan pre-formed dye (Dye-4) |
| | 0.35 | magenta pre-formed dye (Dye-5) |
| | 0.56 | yellow-colored magenta dye former (Dye-12) |
| | 0.09 | soluble red filter dye (Dye-6) |
| Layer 2: | omit | |
| Layer 3: | 21.53 mg/dm$^2$ | gelatin |
| | 4.12 | slow-slow -cyan silver TC-54 |
| | 2.04 | slow cyan silver TC-53 |
| | 3.39 | mid-cyan silver TC-51 |
| | 4.95 | cyan dye former (C-1) |
| | 0.54 | cyan dye forming bleach accelerator (B-1) |
| | 0.28 | cyan dye forming image modifier (DIR-1) |
| Layer 4: | 16.15 mg/dm$^2$ | gelatin |
| | 7.19 | fast cyan silver TC-14 |
| | 0.81 | cyan dye former (C-1) |
| | 0.29 | cyan dye forming image modifier (DIR-1) |
| | 0.43 | magenta colored cyan dye forming masking coupler (MC-1) |
| Layer 5: | 12.92 mg/dm$^2$ | gelatin |
| Layer 6: | 16.68 mg/dm$^2$ | gelatin |
| | 3.10 | slow-slow magenta silver TC-41 |
| | 1.16 | slow magenta silver TC-40 |
| | 2.80 | magenta dye forming coupler (M-2) |
| | 0.16 | soluble green filter dye (Dye-7) |
| Layer 7: | 14.27 mg/dm$^2$ | gelatin |
| | 0.80 | slow-magenta silver TC-40 |
| | 3.01 | mid-magenta silver TC-38 |
| | 0.75 | magenta dye forming coupler (M-2) |
| | 1.51 | yellow colored magenta dye forming masking coupler (MC-2) |
| | 0.16 | magenta image modifier (DIR-4) |
| Layer 8: | 12.63 mg/dm$^2$ | gelatin |
| | 5.39 | fast magenta silver TC-13 |
| | 0.57 | magenta dye forming coupler (M-2) |
| | 0.54 | yellow colored magenta dye forming masking coupler (MC-2) |
| Layer 9: | 8.61 mg/dm$^2$ | gelatin |
| | 0.59 | yellow colloidal silver |
| | 0.54 | Dox scavenger (OxDS-1) |
| Layer 10: | 19.91 mg/dm$^2$ | gelatin |
| | 0.70 | slow-slow yellow silver TC-25 |
| | 0.73 | slow yellow silver TC-23 |
| | 0.73 | mid-yellow silver TC-22 |
| | 2.04 | yellow dye forming coupler (Y-1) |
| | 7.00 | yellow dye forming coupler (Y-2) |
| | 0.54 | cyan dye forming image coupler (C-1) |
| | 0.52 | yellow dye forming image modifier (DIR-3) |
| Layer 11: | 11.30 mg/dm$^2$ | gelatin |
| | 1.92 | slow-fast - yellow silver TC-20 |
| | 2.98 | fast yellow silver TC-19 |
| | 2.26 | yellow dye forming coupler (Y-1) |
| | 2.37 | yellow dye forming coupler (Y-2) |
| | 0.54 | yellow dye forming image modifier (DIR-3) |
| | 0.08 | cyan dye forming bleach |

-continued

| | | |
|---|---|---|
| | | accelerator (B-1) |
| | 0.11 | soluble blue filter dye (Dye-9) |
| Layer 12: | 16.14 mg/dm$^2$ | gelatin |
| | 2.15 | Lippmann silver |
| | 1.08 | UV absorber (Dye-1) |
| | 1.08 | UV absorber (Dye-2) |
| | 1.08 | soluble matte beads |
| | 0.05 | permanent matte beads |
| | lubricants | |
| | 1.60% BVSM | |
| | 4.9% | |
| | Glycerin | |

EXAMPLE D (Invention) 33.48 mg/dm$^2$

| | | |
|---|---|---|
| Layer 1: | 13.45 mg/dm$^2$ | gelatin |
| | 1.61 | black filamentary silver |
| | 0.75 | UV absorber (Dye-2) |
| | 0.16 | yellow tint (Dye-3) |
| | 0.14 | cyan pre-formed dye (Dye-10) |
| | 0.65 | magenta pre-formed dye (Dye-5) |
| | 0.45 | yellow-colored magenta dye former (Dye-12) |
| Layer 2: | 4.31 mg/dm$^2$ | gelatin |
| | 0.54 | Dox scavenger (OxDS-1) |
| Layer 3: | 20.99 mg/dm$^2$ | gelatin |
| | 2.69 | slow cyan silver TC-55 |
| | 7.43 | mid-cyan silver TE-59 |
| | 4.95 | cyan dye former (C-2) |
| | 0.54 | cyan dye forming bleach accelerator (B-2) |
| | 0.27 | cyan dye forming image modifier (DIR-5) |
| Layer 4: | 13.99 mg/dm$^2$ | gelatin |
| | 4.31 | fast cyan silver TE-17 |
| | 0.81 | cyan dye former (C-3) |
| | 0.27 | cyan dye forming image modifier (DIR-5) |
| | 0.32 | magenta colored cyan dye forming masking coupler (MC-3) |
| Layer 5: | 4.31 mg/dm$^2$ | gelatin |
| | 0.54 | Dox scavenger (OxDS-2) |
| Layer 6: | 8.07 mg/dm$^2$ | gelatin |
| | 1.62 | slow magenta silver TC-41 |
| | 1.83 | magenta dye forming coupler (M-2) |
| Layer 7: | 12.92 mg/dm$^2$ | gelatin |
| | 3.55 | mid-magenta silver TE-16 |
| | 0.75 | mid-magenta silver TE-46 |
| | 1.94 | magenta dye forming coupler (M-2) |
| | 1.29 | yellow colored magenta dye forming masking coupler (MC-2) |
| | 0.38 | yellow image modifier (DIR-4) |
| Layer 8: | 10.12 mg/dm$^2$ | gelatin |
| | 4.31 | fast magenta silver TE-15 |
| | 0.69 | magenta dye forming coupler (M-2) |
| | 0.43 | yellow colored magenta dye forming masking coupler (MC-2) |
| Layer 9: | 4.31 mg/dm$^2$ | gelatin |
| | 0.86 | yellow filter dye (Dye-11) |
| | 0.54 | Dox scavenger (OxDS-2) |
| Layer 10: | 17.76 mg/dm$^2$ | gelatin |
| | 2.69 | slow-slow yellow silver TC-25 |
| | 1.29 | slow yellow silver TE-30 |
| | 1.08 | mid-yellow silver TE-29 |
| | 8.72 | yellow dye forming coupler (Y-2) |
| | 1.94 | yellow dye forming coupler (Y-1) |
| | 0.32 | yellow dye forming image modifier (DIR-3) |
| | 0.05 | cyan dye forming bleach accelerator (B-2) |
| Layer 11: | 10.76 mg/dm$^2$ | gelatin |
| | 3.76 | fast yellow silver TE-27 |
| | 1.62 | yellow dye forming coupler (Y-1) |
| | 2.69 | yellow dye forming coupler (Y-2) |
| | 0.65 | yellow dye forming image modifier (DIR-3) |

-continued

| | | |
|---|---|---|
| | 0.05 | cyan dye forming bleach accelerator (B-2) |
| Layer 12: | 15.82 mg/dm$^2$ | gelatin |
| | 1.08 | Lippmann silver |
| | 1.08 | UV absorber (Dye-1) |
| | 1.08 | UV absorber (Dye-2) |
| | 1.08 | soluble matte beads |
| | 0.05 | permanent matte beads |
| | lubricants | |
| | 1.60% BVSM | |
| | 4.9% | |
| | glycerin | |
| | lubricants | |
| Layer 13: | omit | |

EXAMPLE E (Invention—like "D" less modifier) 33.48 mg/dm$^2$

| | | |
|---|---|---|
| Layer 3: | 20.99 mg/dm$^2$ | gelatin |
| | 0.16 | cyan dye forming image modifier (DIR-5) |
| Layer 4: | 13.99 mg/dm$^2$ | gelatin |
| | 0.16 | cyan dye forming image modifier (DIR-5) |
| Layer 7: | 12.92 mg/dm$^2$ | gelatin |
| | 0.25 | yellow image modifier (DIR-4) |
| Layer 10: | 17.76 mg/dm$^2$ | gelatin |
| | 0.22 | yellow dye forming image modifier (DIR-3) |
| Layer 11: | 10.76 mg/dm$^2$ | gelatin |
| | 0.32 | yellow dye forming image modifier (DIR-3) |

EXAMPLE F (Invention—like "D" decreased silver and constant modifier) 21.11 mg/dm$^2$

| | | |
|---|---|---|
| Layer 3: | 20.99 mg/dm$^2$ | gelatin |
| | 1.72 | slow cyan silver TC-55 |
| | 3.98 | mid-cyan silver TE-59 |
| Layer 4: | 13.99 mg/dm$^2$ | gelatin |
| | 2.80 | fast cyan silver TE-17 |
| Layer 6: | 8.07 mg/dm$^2$ | gelatin |
| | 1.08 | slow magenta silver TC-41 |
| Layer 7: | 12.92 mg/dm$^2$ | gelatin |
| | 2.37 | mid magenta silver TE-16 |
| | 0.54 | slow-fast magenta silver TE-46 |
| Layer 8: | 10.12 mg/dm$^2$ | gelatin |
| | 2.80 | fast magenta silver TE-15 |
| Layer 10: | 17.76 mg/dm$^2$ | gelatin |
| | 1.62 | slow-slow yellow silver TC-25 |
| | 0.86 | slow yellow silver TE-30 |
| | 0.86 | mid-yellow silver TE-29 |
| Layer 11: | 10.76 mg/dm$^2$ | gelatin |
| | 2.48 | fast yellow silver TE-27 |

EXAMPLE G (Invention—like "D" but less modifier and less silver) 21.11 mg/dm$^2$

| | | |
|---|---|---|
| Layer 3: | 20.99 mg/dm$^2$ | gelatin |
| | 1.72 | slow cyan silver TC-55 |
| | 3.98 | mid-cyan silver TE-59 |
| | 0.16 | cyan dye forming image modifier (DIR-5) |
| Layer 4: | 13.99 mg/dm$^2$ | gelatin |
| | 2.80 | fast cyan silver TE-17 |
| | 0.16 | cyan dye forming image modifier (DIR-5) |

-continued

| | | |
|---|---|---|
| Layer 6: | 8.07 mg/dm$^2$ | gelatin |
| | 1.08 | slow magenta silver TC-41 |
| Layer 7: | 12.92 mg/dm$^2$ | gelatin |
| | 2.37 | mid magenta silver TE-16 |
| | 0.54 | slow-fast magenta silver TE-46 |
| | 0.25 | yellow image modifier (DIR-4) |
| Layer 8: | 10.12 mg/dm$^2$ | gelatin |
| | 2.80 | fast magenta silver TE-15 |
| Layer 10: | 17.76 mg/dm$^2$ | gelatin |
| | 1.62 | slow-slow yellow silver TC-25 |
| | 0.86 | slow yellow silver TE-30 |
| | 0.86 | mid-yellow silver TE-29 |
| | 0.22 | yellow dye forming image modifier (DIR-3) |
| Layer 11: | 10.76 mg/dm$^2$ | gelatin |
| | 2.48 | fast yellow silver TE-27 |
| | 0.32 | yellow dye forming image modifier (DIR-3) |

-continued

| | | |
|---|---|---|
| Layer 11: | 10.76 mg/dm$^2$ | gelatin |
| | 3.39 | fast yellow silver TE-27 |
| | 1.62 | yellow dye forming coupler (Y-1) |
| | 2.69 | yellow dye forming coupler (Y-2) |
| | 0.58 | yellow dye forming image modifier (DIR-3) |
| | 0.05 | cyan dye forming bleach accelerator (B-2) |
| Layer 12: | 15.82 mg/dm$^2$ | gelatin |
| | 1.08 | Lippmann silver |
| | 1.08 | UV absorber (Dye-1) |
| | 1.08 | UV absorber (Dye-2) |
| | 1.08 | soluble matte beads |
| | 0.05 | permanent matte beads |
| | lubricants | |
| | 1.60% BVSM | |
| | 4.9% glycerin | |
| Layer 13: | omit | |

EXAMPLE H (Invention) 25.67 mg/dm$^2$

| | | |
|---|---|---|
| Layer 1: | 13.45 mg/dm$^2$ | gelatin |
| | 1.61 | black filamentary silver |
| | 0.75 | UV absorber (Dye-2) |
| | 0.16 | yellow tint (Dye-3) |
| | 0.14 | cyan pre-formed dye (Dye-4) |
| | 0.65 | magenta pre-formed dye (Dye-5) |
| | 0.45 | yellow-colored magenta dye former (Dye-12) |
| Layer 2: | 4.31 mg/dm$^2$ | gelatin |
| | 0.54 | Dox scavenger OxDS-2 |
| Layer 3: | 20.99 mg/dm$^2$ | gelatin |
| | 1.83 | slow cyan silver TC-55 |
| | 5.05 | mid-cyan silver TE-59 |
| | 4.95 | cyan dye former (C-2) |
| | 0.54 | cyan dye forming bleach accelerator (B-2) |
| | 0.18 | cyan dye forming image modifier (DIR-5) |
| Layer 4: | 13.99 mg/dm$^2$ | gelatin |
| | 3.29 | fast cyan silver TE-17 |
| | 0.81 | cyan dye former (C-3) |
| | 0.20 | cyan dye forming image modifier (DIR-5) |
| | 0.32 | magenta colored cyan dye forming masking coupler (MC-3) |
| Layer 5: | 4.31 mg/dm$^2$ | gelatin |
| | 0.54 | Dox scavenger (OxDS-2) |
| Layer 6: | 8.07 mg/dm$^2$ | gelatin |
| | 1.04 | slow magenta silver TC-41 |
| | 1.83 | magenta dye forming coupler (M-2) |
| Layer 7: | 12.92 mg/dm$^2$ | gelatin |
| | 2.45 | mid-magenta silver TE-16 |
| | 0.52 | mid-magenta silver TE-46 |
| | 1.94 | magenta dye forming coupler (M-2) |
| | 1.29 | yellow colored magenta dye forming masking coupler (MC-2) |
| | 0.26 | yellow image modifier (DIR-4) |
| Layer 8: | 10.12 mg/dm$^2$ | gelatin |
| | 3.59 | fast magenta silver TE-15 |
| | 0.69 | magenta dye forming coupler (M-2) |
| | 0.43 | yellow colored magenta dye forming masking coupler (MC-2) |
| Layer 9: | 4.31 mg/dm$^2$ | gelatin |
| | 0.86 | yellow filter dye (Dye-11) |
| | 0.54 | Dox scavenger (OxDS-2) |
| Layer 10: | 17.76 mg/dm$^2$ | gelatin |
| | 2.21 | slow-slow yellow silver TC-25 |
| | 1.15 | slow yellow silver TE-30 |
| | 1.15 | mid-yellow silver TE-29 |
| | 8.72 | yellow dye forming coupler (Y-2) |
| | 1.94 | yellow dye forming coupler (Y-1) |
| | 0.29 | yellow dye forming image modifier (DIR-3) |
| | 0.05 | cyan dye forming bleach accelerator (B-2) |

EXAMPLE I (Invention without yellow filter dye in layer 9) 18.04 mg/dm$^2$

| | | |
|---|---|---|
| Layer 1: | 13.45 mg/dm$^2$ | gelatin |
| | 1.61 | black filamentary silver |
| | 0.75 | UV absorber (Dye-2) |
| | 0.16 | yellow tint (Dye-3) |
| | 0.14 | cyan pre-formed dye Dye-10 |
| | 0.65 | magenta pre-formed dye (Dye-5) |
| | 0.45 | yellow-colored magenta dye former (Dye-12) |
| Layer 2: | 4.31 mg/dm$^2$ | gelatin |
| | 0.54 | Dox scavenger (OxDS-2) |
| Layer 3: | 20.99 mg/dm$^2$ | gelatin |
| | 1.32 | slow cyan silver TC-55 |
| | 3.64 | mid-cyan silver TE-59 |
| | 4.95 | cyan dye former (C-2) |
| | 0.54 | cyan dye forming bleach accelerator (B-2) |
| | 0.13 | cyan dye forming image modifier (DIR-5) |
| Layer 4: | 13.99 mg/dm$^2$ | gelatin |
| | 2.38 | fast cyan silver TE-17 |
| | 0.81 | cyan dye former (C-3) |
| | 0.15 | cyan dye forming image modifier (DIR-5) |
| | 0.32 | magenta colored cyan dye forming masking coupler (MC-3) |
| Layer 5: | 4.31 mg/dm$^2$ | gelatin |
| | 0.54 | Dox scavenger (OxDS-2) |
| Layer 6: | 8.07 mg/dm$^2$ | gelatin |
| | 0.53 | slow magenta silver TC-41 |
| | 1.83 | magenta dye forming coupler (M-2) |
| Layer 7: | 12.92 mg/dm$^2$ | gelatin |
| | 0.96 | mid-magenta silver TE-16 |
| | 0.20 | mid-magenta silver TE-46 |
| | 1.94 | magenta dye forming coupler (M-2) |
| | 1.29 | yellow colored magenta dye forming masking coupler (MC-2) |
| | 0.10 | yellow image modifier (DIR-4) |
| Layer 8: | 10.12 mg/dm$^2$ | gelatin |
| | 2.20 | fast magenta silver TE-15 |
| | 0.69 | magenta dye forming coupler (M-2) |
| | 0.43 | yellow colored magenta dye forming masking coupler (MC-2) |
| Layer 9: | 4.31 mg/dm$^2$ | gelatin |
| | omit | yellow filter dye (Dye-11) |
| | 0.54 | Dox scavenger (OxDS-2) |
| Layer 10: | 17.76 mg/dm$^2$ | gelatin |
| | 1.76 | slow-slow yellow silver TC-25 |
| | 0.92 | slow yellow silver TE-30 |
| | 0.92 | mid-yellow silver TE-29 |
| | 8.72 | yellow dye forming coupler (Y-2) |
| | 1.94 | yellow dye forming coupler (Y-1) |
| | 0.23 | yellow dye forming image modifier (DIR-3) |

-continued

| | | |
|---|---|---|
| | 0.05 | cyan dye forming bleach accelerator (B-2) |
| Layer 11: | 10.76 mg/dm$^2$ | gelatin |
| | 3.21 | fast yellow silver TE-27 |
| | 1.62 | yellow dye forming coupler (Y-1) |
| | 2.69 | yellow dye forming coupler (Y-2) |
| | 0.55 | yellow dye forming image modifier (DIR-3) |
| | 0.05 | cyan dye forming bleach accelerator (B-2) |
| Layer 12: | 15.82 mg/dm$^2$ | gelatin |
| | 1.08 | Lippmann silver |
| | 1.08 | UV absorber (Dye-1) |
| | 1.08 | UV absorber (Dye-2) |
| | 1.08 | soluble matte beads |
| | 0.05 | permanent matte beads |
| | lubricants | |
| | 1.60% BVSM | |
| | 4.9% | |
| | glycerin | |
| Layer 13: | omit | |

EXAMPLE J (Invention as in H with yellow filter dye and with less modifier in fast yellow layer 11) 18.04 mg/dm$^2$

| | | |
|---|---|---|
| Layer 11: | 10.76 mg/dm$^2$ | gelatin |
| | 0.32 | yellow dye forming image modifier (DIR-3) |

EXAMPLE K (Invention without yellow filter dye) 18.04 mg/dm$^2$

| | | |
|---|---|---|
| Layer 1: | 13.45 mg/dm$^2$ | gelatin |
| | 1.61 | black filamentary silver |
| | 0.75 | UV absorber (Dye-2) |
| | 0.16 | yellow tint (Dye-3) |
| | 0.14 | cyan pre-formed dye (Dye-10) |
| | 0.65 | magenta pre-formed dye (Dye-5) |
| | 0.45 | yellow-colored magenta dye former (Dye-12) |
| Layer 2: | 4.31 mg/dm$^2$ | gelatin |
| | 0.54 | Dox scavenger (OxDS-2) |
| Layer 3: | 20.99 mg/dm$^2$ | gelatin |
| | 1.32 | slow cyan silver TC-55 |
| | 3.64 | mid-cyan silver TE-59 |
| | 4.31 | cyan dye former (C-2) |
| | 0.54 | cyan dye forming bleach accelerator (B-2) |
| | 0.13 | cyan dye forming image modifier (DIR-4) |
| Layer 4: | 13.99 mg/dm$^2$ | gelatin |
| | 2.38 | fast cyan silver TE-17 |
| | 0.81 | cyan dye former (C-3) |
| | 0.15 | cyan dye forming image modifier (DIR-5) |
| | 0.32 | magenta colored cyan dye forming masking coupler (MC-3) |
| Layer 5: | 4.31 mg/dm$^2$ | gelatin |
| | 0.54 | Dox scavenger (OxDS-2) |
| Layer 6: | 8.07 mg/dm$^2$ | gelatin |
| | 0.53 | slow magenta silver TC-41 |
| | 1.62 | magenta dye forming coupler (M-2) |
| Layer 7: | 12.92 mg/dm$^2$ | gelatin |
| | 0.96 | mid-magenta silver TE-16 |
| | 0.20 | mid-magenta silver TE-46 |
| | 1.29 | magenta dye forming coupler (M-2) |
| | 0.65 | yellow colored magenta dye forming masking coupler (MC-2) |
| | 0.10 | yellow image modifier (DIR-4) |
| Layer 8: | 10.12 mg/dm$^2$ | gelatin |
| | 2.20 | fast magenta silver TE-15 |

-continued

| | | |
|---|---|---|
| | 0.54 | magenta dye forming coupler (M-2) |
| | 0.43 | yellow colored magenta dye forming masking coupler (MC-2) |
| Layer 9: | 4.31 mg/dm$^2$ | gelatin |
| | omit | yellow filter dye (Dye-11) |
| | 0.54 | Dox scavenger (OxDS-2) |
| Layer 10: | 17.76 mg/dm$^2$ | Gelatin |
| | 1.76 | slow-slow yellow silver TC-25 |
| | 0.92 | slow yellow silver TE-30 |
| | 0.92 | mid-yellow silver TE-29 |
| | 8.72 | yellow dye forming coupler (Y-2) |
| | 1.94 | yellow dye forming coupler (Y-1) |
| | 0.23 | yellow dye forming image modifier (DIR-3) |
| | 0.05 | cyan dye forming bleach accelerator (B-2) |
| Layer 11: | 10.76 mg/dm$^2$ | gelatin |
| | 3.21 | fast yellow silver TE-27 |
| | 1.29 | yellow dye forming coupler (Y-1) |
| | 2.15 | yellow dye forming coupler (Y-2) |
| | 0.32 | yellow dye forming image modifier (DIR-3) |
| | 0.05 | cyan dye forming bleach accelerator (B-2) |
| Layer 12: | 15.82 mg/dm$^2$ | gelatin |
| | 1.08 | Lippmann silver |
| | 1.08 | UV absorber (Dye-1) |
| | 1.08 | UV absorber (Dye-2) |
| | 1.08 | soluble matte beads |
| | 0.05 | permanent matte beads |
| | lubricants | |
| | 1.60% BVSM | |
| | 4.9% | |
| | glycerin | |
| Layer 13: | omit | |

EXAMPLE L (Invention) 21.11 mg/dm$^2$

| | | |
|---|---|---|
| Layer 1: | 13.45 mg/dm$^2$ | gelatin |
| | 1.61 | black filamentary silver |
| | 0.75 | UV absorber (Dye-2) |
| | 0.16 | yellow tint (Dye-3) |
| | 0.14 | cyan pre-formed dye (Dye-10) |
| | 0.65 | magenta pre-formed dye (Dye-5) |
| | 0.45 | yellow-colored magenta dye former (Dye-12) |
| Layer 2: | 4.31 mg/dm$^2$ | gelatin |
| | 0.54 | Dox scavenger (OxDS-2) |
| Layer 3: | 20.99 mg/dm$^2$ | gelatin |
| | 1.72 | slow cyan silver TC-55 |
| | 3.98 | mid-cyan silver TE-59 |
| | 4.31 | cyan dye former (C-2) |
| | 0.54 | cyan dye forming bleach accelerator (B-2) |
| | 0.16 | cyan dye forming image modifier (DIR-5) |
| Layer 4: | 13.99 mg/dm$^2$ | gelatin |
| | 2.80 | fast cyan silver TE-17 |
| | 0.81 | cyan dye former (C-3) |
| | 0.16 | cyan dye forming image modifier (DIR-5) |
| | 0.32 | magenta colored cyan dye forming masking coupler (MC-3) |
| Layer 5: | 4.31 mg/dm$^2$ | gelatin |
| | 0.54 | Dox scavenger (OxDS-2) |
| Layer 6: | 8.07 mg/dm$^2$ | gelatin |
| | 1.08 | slow magenta silver TC-41 |
| | 1.62 | magenta dye forming coupler (M-2) |
| Layer 7: | 12.92 mg/dm$^2$ | gelatin |
| | 2.37 | mid-magenta silver TE-16 |
| | 0.54 | mid-magenta silver TE-46 |
| | 1.29 | magenta dye forming coupler (M-2) |
| | 0.65 | yellow colored magenta dye forming masking coupler (MC-2) |
| | 0.25 | yellow image modifier (DIR-4) |

-continued

| | | |
|---|---|---|
| Layer 8: | 10.12 mg/dm$^2$ | gelatin |
| | 2.80 | fast magenta silver TE-15 |
| | 0.54 | magenta dye forming coupler (M-2) |
| | 0.43 | yellow colored magenta dye forming masking coupler (MC-2) |
| Layer 9: | 4.31 mg/dm$^2$ | gelatin |
| | omit | yellow filter dye (Dye-11) |
| | 0.54 | Dox scavenger (OxDS-2) |
| Layer 10: | 17.76 mg/dm$^2$ | gelatin |
| | 1.62 | slow-slow yellow silver TC-25 |
| | 0.86 | slow yellow silver TE-30 |
| | 0.862 | mid-yellow silver TE-29 |
| | 8.72 | yellow dye forming coupler (Y-2) |
| | 1.94 | yellow dye forming coupler (Y-1) |
| | 0.22 | yellow dye forming image modifier (DIR-3) |
| | 0.05 | cyan dye forming bleach accelerator (B-2) |
| Layer 11: | 10.76 mg/dm$^2$ | gelatin |
| | 2.48 | fast yellow silver TE-27 |
| | 1.29 | yellow dye forming coupler (Y-1) |
| | 2.15 | yellow dye forming coupler (Y-2) |
| | 0.32 | yellow dye forming image modifier (DIR-3) |
| | 0.05 | cyan dye forming bleach accelerator (B-2) |
| Layer 12: | 15.82 mg/dm$^2$ | gelatin |
| | 1.08 | Lippmann silver |
| | 1.08 | UV absorber (Dye-1) |
| | 1.08 | UV absorber (Dye-2) |
| | 1.08 | soluble matte beads |
| | 0.05 | permanent matte beads |
| | lubricants | |
| | 1.60% BVSM | |
| | 4.9% glycerin | |
| Layer 13: | omit | |

Example M (Invention) 25.67 mg/dm$^2$

| | | |
|---|---|---|
| Layer 1: | 13.45 mg/dm$^2$ | gelatin |
| | 1.61 | black filamentary silver |
| | 0.75 | UV absorber (Dye-2) |
| | 0.16 | yellow tint (Dye-3) |
| | 0.14 | cyan pre-formed dye (Dye-10) |
| | 0.65 | magenta pre-formed dye (Dye-5) |
| | 0.45 | yellow-colored magenta dye former (Dye-12) |
| Layer 2: | 4.31 mg/dm$^2$ | gelatin |
| | 0.54 | Dox scavenger (OxDS-2) |
| Layer 3: | 20.99 mg/dm$^2$ | gelatin |
| | 1.83 | slow cyan silver TC-55 |
| | 5.05 | mid-cyan silver TE-59 |
| | 4.31 | cyan dye former (C-2) |
| | 0.54 | cyan dye forming bleach accelerator (B-2) |
| | 0.16 | cyan dye forming image modifier (DIR-5) |
| Layer 4: | 13.99 mg/dm$^2$ | gelatin |
| | 3.29 | fast cyan silver TE-17 |
| | 0.81 | cyan dye former (C-3) |
| | 0.16 | cyan dye forming image modifier (DIR-5) |
| | 0.32 | magenta colored cyan dye forming masking coupler (MC-3) |
| Layer 5: | 4.31 mg/dm$^2$ | gelatin |
| | 0.54 | Dox scavenger (OxDS-2) |
| Layer 6: | 8.07 mg/dm$^2$ | gelatin |
| | 1.04 | slow magenta silver TC-41 |
| | 1.62 | magenta dye forming coupler (M-2) |
| Layer 7: | 12.92 mg/dm$^2$ | gelatin |
| | 2.45 | mid-magenta silver TE-16 |
| | 0.52 | mid-magenta silver TE-46 |
| | 1.29 | magenta dye forming coupler (M-2) |
| | 0.65 | yellow colored magenta dye forming masking coupler (MC-2) |

-continued

| | | |
|---|---|---|
| | 0.25 | yellow image modifier (DIR-4) |
| Layer 8: | 10.12 mg/dm$^2$ | gelatin |
| | 3.59 | fast magenta silver TE-15 |
| | 0.54 | magenta dye forming coupler (M-2) |
| | 0.43 | yellow colored magenta dye forming masking coupler (MC-2) |
| Layer 9: | 4.31 mg/dm$^2$ | gelatin |
| | omit | yellow filter dye (Dye-11) |
| | 0.54 | Dox scavenger (OxDS-2) |
| Layer 10: | 17.76 mg/dm$^2$ | gelatin |
| | 2.21 | slow slow yellow silver TC-25 |
| | 1.15 | slow yellow silver TE-30 |
| | 1.15 | mid-yellow silver TE-29 |
| | 8.72 | yellow dye forming coupler (Y-2) |
| | 1.94 | yellow dye forming coupler (Y-1) |
| | 0.22 | yellow dye forming image modifier (DIR-3) |
| | 0.05 | cyan dye forming bleach accelerator (B-2) |
| Layer 11: | 10.76 mg/dm$^2$ | gelatin |
| | 3.39 | fast yellow silver TE-27 |
| | 1.29 | yellow dye forming coupler (Y-1) |
| | 2.15 | yellow dye forming coupler (Y-2) |
| | 0.32 | yellow dye forming image modifier (DIR-3) |
| | 0.05 | cyan dye forming bleach accelerator (B-2) |
| Layer 12: | 15.82 mg/dm$^2$ | gelatin |
| | 1.08 | Lippmann silver |
| | 1.08 | UV absorber (Dye-1) |
| | 1.08 | UV absorber (Dye-2) |
| | 1.08 | soluble matte beads |
| | 0.05 | permanent matte beads |
| | lubricants | |
| | 1.60% BVSM | |
| | 4.9% glycerin | |
| Layer 13: | omit | |

EXAMPLE N. (Invention) 22.22 mg/dm$^2$

| | | |
|---|---|---|
| Layer 1: | | gelatin |
| | 1.29 | black filamentary silver |
| | 0.75 | UV absorber (Dye-2) |
| | 0.29 | cyan pre-formed dye (Dye-10) |
| | 0.16 | magenta pre-formed dye (Dye-5) |
| | 1.25 | yellow-colored magenta dye former (Dye-12) |
| | 0.16 | yellow tint (Dye-3) |
| | 0.07 | soluble red filter dye (Dye-6) |
| Layer 2: | 5.38 mg/dm$^2$ | gelatin |
| | 0.54 | Dox scavenger (OxDS-2) |
| | 0.21 | Gelatin thickener (T-1) |
| Layer 3: | 20.98 mg/dm$^2$ | gelatin |
| | 2.37 | slow-slow -cyan silver TC-57 |
| | 0.64 | slow-cyan silver TC-52 |
| | 3.22 | mid-cyan silver TE-60 |
| | 7.10 | cyan dye former (C-1) |
| | 0.54 | cyan dye forming bleach accelerator (B-1) |
| | 0.21 | cyan dye forming image modifier (DIR-6) |
| | 0.43 | cyan dye forming image modifier (DIR-7) |
| | 0.19 | magenta colored cyan dye forming masking coupler (MC-1) |
| Layer 4: | 13.99 mg/dm$^2$ | gelatin |
| | 3.01 | fast cyan silver TE-58 |
| | 1.61 | cyan dye former (C-1) |
| | 0.11 | cyan dye forming image modifier (DIR-6) |
| | 0.43 | cyan dye forming image modifier (DIR-7) |
| | 0.32 | magenta colored cyan dye forming masking coupler (MC-1) |

-continued

| | | |
|---|---|---|
| Layer 5: | 5.38 mg/dm$^2$ | gelatin |
| | 0.54 | Dox scavenger (OxDS-2) |
| | 0.21 | Gelatin thickener (T-1) |
| Layer 6: | 11.84 mg/dm$^2$ | gelatin |
| | 1.29 | slow-slow magenta silver TC-44 |
| | 0.38 | slow magenta silver TC-40 |
| | 2.37 | magenta dye forming coupler (M-2) |
| | 0.21 | yellow colored magenta dye forming masking coupler (MC-2) |
| | 0.64 | Gelatin thickener (T-1) |
| | 0.07 | soluble green filter dye (Dye-7) |
| Layer 7: | 11.30 mg/dm$^2$ | gelatin |
| | 2.36 | mid-magenta silver TE-47 |
| | 1.29 | magenta dye forming coupler (M-2) |
| | 0.64 | yellow colored magenta dye forming masking coupler (MC-2) |
| | 0.05 | magenta image modifier (DIR-2) |
| | 0.22 | cyan dye forming image modifier (DIR-6) |
| | 0.11 | Gelatin thickener (T-1) |
| Layer 8: | 11.30 mg/dm$^2$ | gelatin |
| | 3.12 | fast magenta silver TE-45 |
| | 0.97 | magenta dye forming coupler (M-2) |
| | 0.03 | magenta image modifier (DIR-2) |
| | 0.40 | Gelatin thickener (T-1) |
| Layer 9: | 5.38 mg/dm$^2$ | gelatin |
| | 0.54 | Dox scavenger (OxDS-2) |
| Layer 10: | 15.60 mg/dm$^2$ | gelatin |
| | 1.61 | slow-slow -yellow silver TC-26 |
| | 0.86 | slow-yellow silver TE-33 |
| | 0.43 | mid-yellow silver TE-32 |
| | 9.04 | yellow dye forming coupler (Y-4) |
| | 0.16 | yellow dye forming image modifier (DIR-8) |
| | 0.05 | cyan dye forming bleach accelerator (B-1) |
| | 0.40 | Gelatin thickener (T-1) |
| Layer 11: | 10.77 mg/dm$^2$ | gelatin |
| | 1.61 | slow-fast yellow silver TE-28 |
| | 1.61 | fast yellow silver TC-19 |
| | 1.51 | yellow dye forming coupler (Y-1) |
| | 1.51 | yellow dye forming coupler) (Y-4) |
| | 0.16 | yellow dye forming image modifier (DIR-8) |
| | 0.05 | cyan dye forming bleach accelerator (B-1) |
| | 0.07 | Gelatin thickener (T-1) |
| | 0.21 | soluble blue filter dye (Dye-9) |
| Layer 12: | 6.99 mg/dm$^2$ | gelatin |
| | 1.08 | Lippmann silver |
| | 1.08 | UV absorber (Dye-1) |
| | 1.08 | UV absorber (Dye-2) |
| Layer 13: | 8.88 mg/dm$^2$ | gelatin |
| | 1.08 | soluble matte beads |
| | 0.05 | permanent matte beads |
| | lubricants | |
| | 1.60% BVSM | |
| | 4.9% | |
| | Glycerin | |

EXAMPLE O. (Invention) 23.30 mg/dm$^2$

| | | |
|---|---|---|
| Layer 1: | | gelatin |
| | 1.29 | black filamentary silver |
| | 0.75 | UV absorber (Dye-2) |
| | 0.29 | cyan pre-formed dye (Dye-10) |
| | 0.16 | magenta pre-formed dye (Dye-5) |
| | 1.25 | yellow-colored magenta dye former (Dye-12) |
| | 0.16 | yellow tint (Dye-3) |
| | 0.07 | soluble red filter dye (Dye-6) |
| Layer 2: | 5.38 mg/dm$^2$ | gelatin |
| | 0.54 | Dox scavenger (OxDS-2) |
| | 0.21 | Gelatin thickener (T-1) |

-continued

| | | |
|---|---|---|
| Layer 3: | 20.98 mg/dm$^2$ | gelatin |
| | 2.37 | slow-slow -cyan silver TC-57 |
| | 0.64 | slow-cyan silver TC-52 |
| | 3.22 | mid-cyan silver TE-60 |
| | 7.10 | cyan dye former (C-1) |
| | 0.54 | cyan dye forming bleach accelerator (B-1) |
| | 0.21 | cyan dye forming image modifier (DIR-6) |
| | 0.43 | cyan dye forming image modifier (DIR-7) |
| | 0.19 | magenta colored cyan dye forming masking coupler (MC-1) |
| Layer 4: | 13.99 mg/dm$^2$ | gelatin |
| | 3.01 | fast cyan silver TE-58 |
| | 1.61 | cyan dye former (C-1) |
| | 0.11 | cyan dye forming image modifier (DIR-6) |
| | 0.43 | cyan dye forming image modifier (DIR-7) |
| | 0.32 | magenta colored cyan dye forming masking coupler (MC-1) |
| Layer 5: | 5.38 mg/dm$^2$ | gelatin |
| | 0.54 | Dox scavenger (OxDS-2) |
| | 0.21 | Gelatin thickener (T-1) |
| Layer 6: | 11.84 mg/dm$^2$ | gelatin |
| | 1.29 | slow-slow magenta silver TC-44 |
| | 0.38 | slow magenta silver TC-40 |
| | 2.37 | magenta dye forming coupler (M-2) |
| | 0.21 | yellow colored magenta dye forming masking coupler (MC-2) |
| | 0.64 | Gelatin thickener (T-1) |
| | 0.07 | soluble green filter dye (Dye-7) |
| Layer 7: | 11.30 mg/dm$^2$ | gelatin |
| | 1.82 | slow magenta silver TC-40 |
| | 1.29 | Mid-magenta silver TC-37 |
| | 1.08 | magenta dye forming coupler (M-2) |
| | 0.64 | yellow colored magenta dye forming masking coupler (MC-2) |
| | 0.05 | magenta image modifier (DIR-2) |
| | 0.22 | cyan dye forming image modifier (DIR-6) |
| | 0.11 | Gelatin thickener (T-1) |
| Layer 8: | 11.30 mg/dm$^2$ | gelatin |
| | 3.12 | fast magenta silver TE-45 |
| | 0.97 | magenta dye forming coupler (M-2) |
| | 0.03 | magenta image modifier (DIR-2) |
| | 0.40 | Gelatin thickener (T-1) |
| Layer 9: | 5.38 mg/dm$^2$ | gelatin |
| | 0.54 | Dox scavenger (OxDS-2) |
| Layer 10: | 15.60 mg/dm$^2$ | gelatin |
| | 1.61 | slow-slow -yellow silver TC-26 |
| | 0.86 | slow yellow silver TE-33 |
| | 0.43 | mid-yellow silver TE-32 |
| | 9.04 | yellow dye forming coupler (Y-4) |
| | 0.16 | yellow dye forming image modifier (DIR-8) |
| | 0.05 | cyan dye forming bleach accelerator (B-1) |
| | 0.40 | Gelatin thickener (T-1) |
| Layer 11: | 10.77 mg/dm$^2$ | gelatin |
| | 1.61 | slow-fast yellow silver TE-28 |
| | 1.61 | fast yellow silver TC-19 |
| | 1.51 | yellow dye forming coupler (Y-1) |
| | 1.51 | yellow dye forming coupler) (Y-4) |
| | 0.16 | yellow dye forming image modifier (DIR-8) |
| | 0.05 | cyan dye forming bleach accelerator (B-1) |
| | 0.07 | Gelatin thickener (T-1) |
| | 0.21 | soluble blue filter dye (Dye-9) |
| Layer 12: | 6.99 mg/dm$^2$ | gelatin |
| | 1.08 | Lippmann silver |
| | 1.08 | UV absorber (Dye-1) |
| | 1.08 | UV absorber (Dye-2) |

-continued

| | | |
|---|---|---|
| Layer 13: | 8.88 mg/dm$^2$ | gelatin |
| | 1.08 | soluble matte beads |
| | 0.05 | permanent matte beads |
| | lubricants | |
| | 1.60% BVSM | |
| | 4.9% | |
| | Glycerin | |

Comparative Example P—imaging silver at 26.63 mg/dm$^2$

| | | |
|---|---|---|
| Layer 1: | 21.53 mg/dm$^2$ | gelatin |
| | 1.51 | black filamentary silver |
| | 1.61 | Dox scavenger (OxDS-2) |
| | 0.32 | UV absorber (Dye-1) |
| | 0.75 | UV absorber (Dye-2) |
| | 0.07 | cyan pre-formed dye (Dye-4) |
| | 0.35 | magenta pre-formed dye (Dye-5) |
| | 0.56 | yellow-colored magenta dye former (Dye-12) |
| | 0.09 | soluble red filter dye (Dye-6) |
| Layer 2: | omit | |
| Layer 3: | 21.53 mg/dm$^2$ | gelatin |
| | 2.62 | slow-slow -cyan silver TC-54 |
| | 1.30 | slow cyan silver TC-53 |
| | 2.15 | mid-cyan silver TC-51 |
| | 0.17 | cyan dye former (DIR-1) |
| | 0.54 | cyan dye forming bleach accelerator (B-1) |
| | 0.28 | cyan dye forming image modifier (DIR-1) |
| Layer 4: | 16.15 mg/dm$^2$ | gelatin |
| | 5.26 | fast cyan silver TC-14 |
| | 0.81 | cyan dye former (C-1) |
| | 0.22 | cyan dye forming image modifier (DIR-1) |
| | 0.43 | magenta colored cyan dye forming masking coupler (MC-1) |
| Layer 5: | 12.92 mg/dm$^2$ | gelatin |
| Layer 6: | 16.68 mg/dm$^2$ | gelatin |
| | 2.41 | slow-slow magenta silver TC-41 |
| | 0.90 | slow magenta silver TC-40 |
| | 2.80 | magenta dye forming coupler (M-2) |
| | 0.16 | soluble green filter dye (Dye-7) |

-continued

| | | |
|---|---|---|
| Layer 7: | 14.27 mg/dm$^2$ | gelatin |
| | 0.58 | slow-magenta silver TC-40 |
| | 2.22 | mid-magenta silver TC-38 |
| | 0.75 | magenta dye forming coupler (M-2) |
| | 1.51 | yellow colored magenta dye forming masking coupler (MC-2) |
| | 0.09 | magenta image modifier (DIR-4) |
| Layer 8: | 12.63 mg/dm$^2$ | gelatin |
| | 3.72 | fast magenta silver TC-13 |
| | 0.57 | magenta dye forming coupler (M-2) |
| | 0.54 | yellow colored magenta dye forming masking coupler (MC-2) |
| Layer 9: | 8.61 mg/dm$^2$ | gelatin |
| | 0.59 | yellow colloidal silver |
| | 0.54 | Dox scavenger (OxDS-1) |
| Layer 10: | 19.91 mg/dm$^2$ | gelatin |
| | 0.53 | slow-slow yellow silver TC-25 |
| | 0.55 | slow yellow silver TC-23 |
| | 0.55 | mid-yellow silver TC-22 |
| | 2.04 | yellow dye forming coupler (Y-1) |
| | 7.00 | yellow dye forming coupler (Y-2) |
| | 0.54 | cyan dye forming image coupler (C-1) |
| | 0.39 | yellow dye forming image modifier (DIR-3) |
| Layer 11: | 11.30 mg/dm$^2$ | gelatin |
| | 1.50 | slow-fast - yellow silver TC-20 |
| | 2.34 | fast yellow silver TC-19 |
| | 0.42 | yellow dye forming coupler (Y-1) |
| | 2.37 | yellow dye forming coupler (Y-2) |
| | 0.54 | yellow dye forming image modifier (DIR-3) |
| | 0.08 | cyan dye forming bleach accelerator (B-1) |
| | 0.11 | soluble blue filter dye (Dye-9) |
| Layer 12: | 16.14 mg/dm$^2$ | gelatin |
| | 2.15 | Lippmann silver |
| | 1.08 | UV absorber (Dye-1) |
| | 1.08 | UV absorber (Dye-2) |
| | 1.08 | soluble matte beads |
| | 0.05 | permanent matte beads |
| | lubricants | |
| | 1.60% BVSM | |
| | 4.9% | |
| | Glycerin | |

The following structures were used in the multilayer examples:

B-1
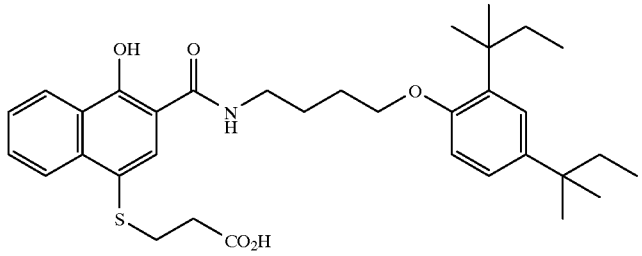
B-2
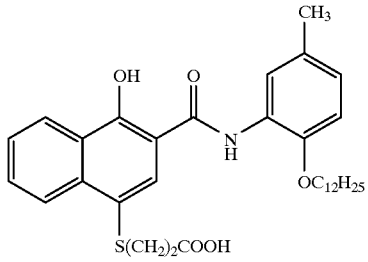
C-1
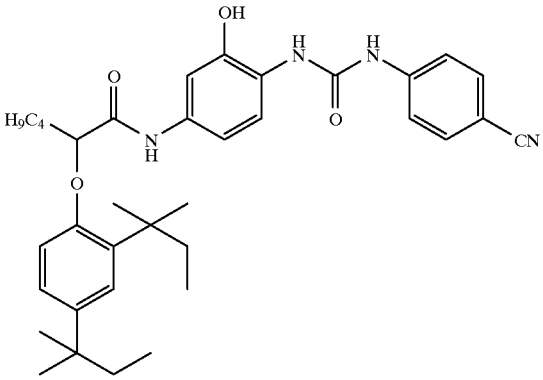
C-2
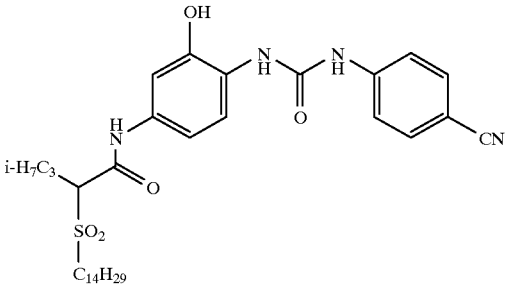
C-3
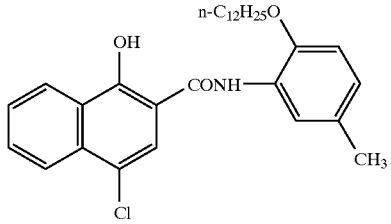

-continued
DIR-1
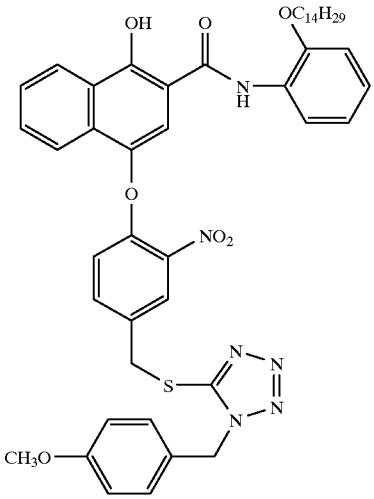
DIR-2
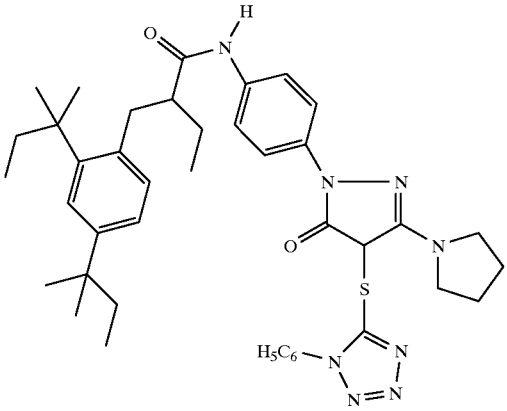
DIR-3
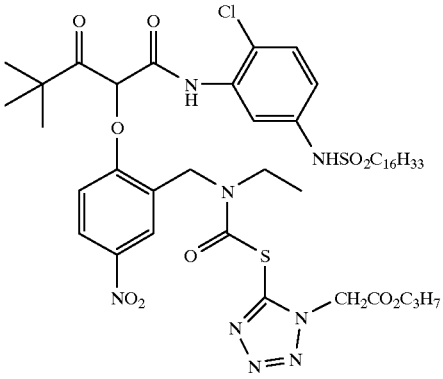
DIR-4
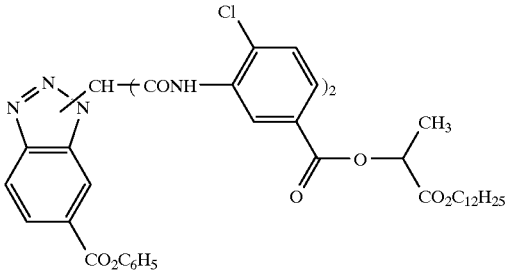

-continued
DIR-5
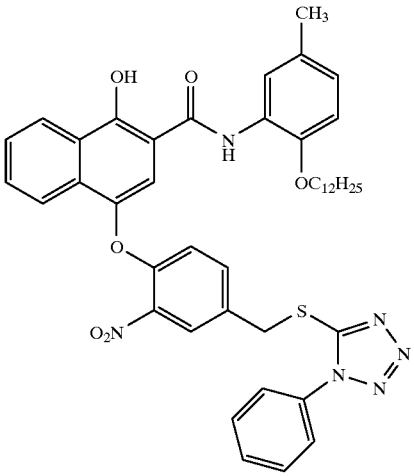
DIR-6
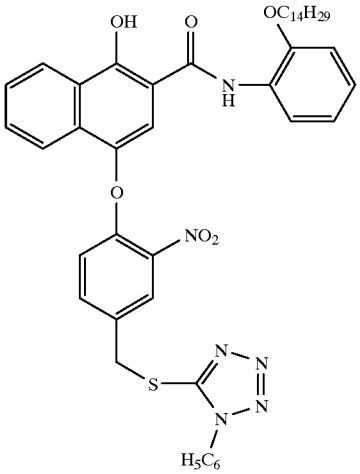
DIR-7
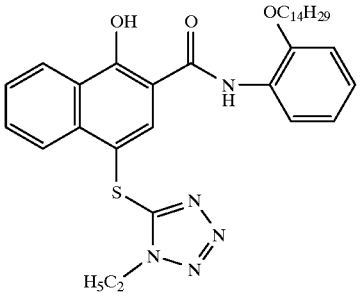
DIR-8
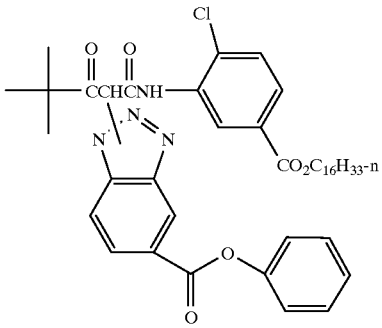

-continued
DYE-1
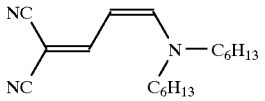
DYE-2
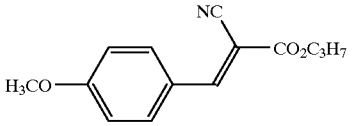
DYE-3
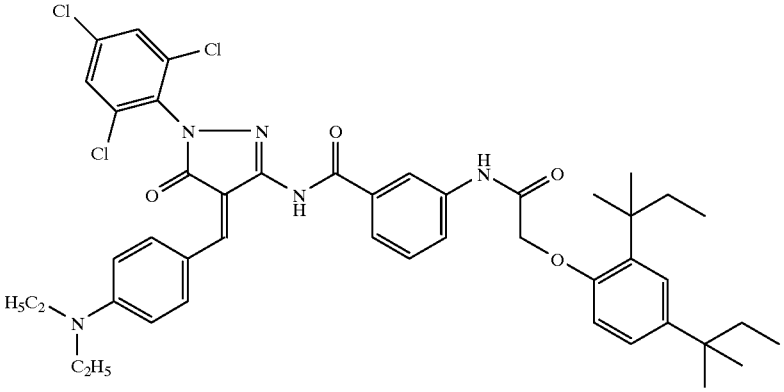
DYE-4
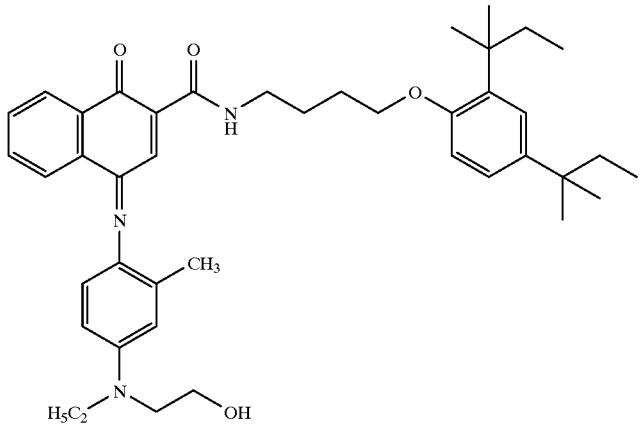
DYE-5
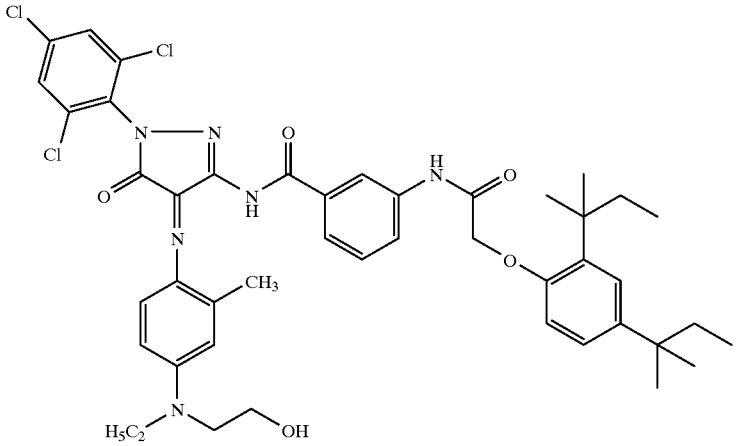

-continued
DYE-6
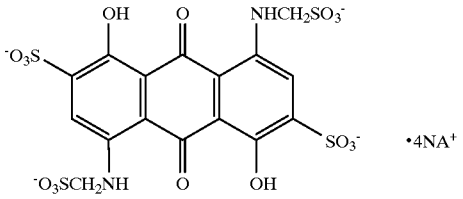
DYE-7
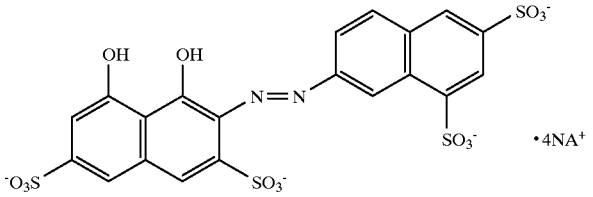
DYE-9
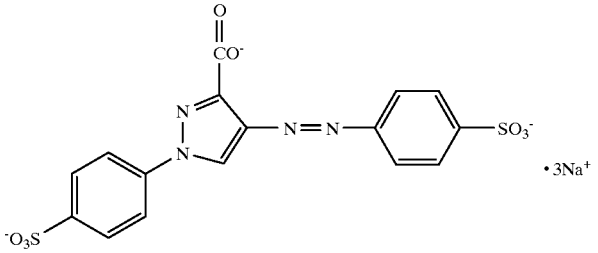
DYE-10
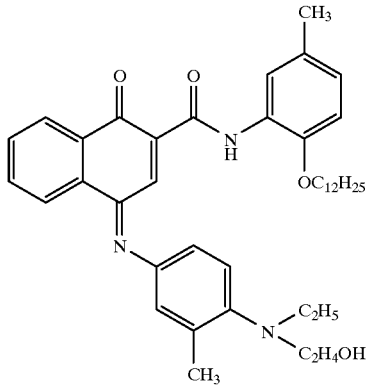
DYE-11
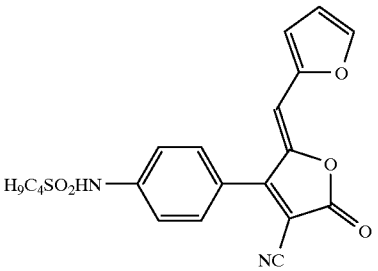

-continued
DYE-12
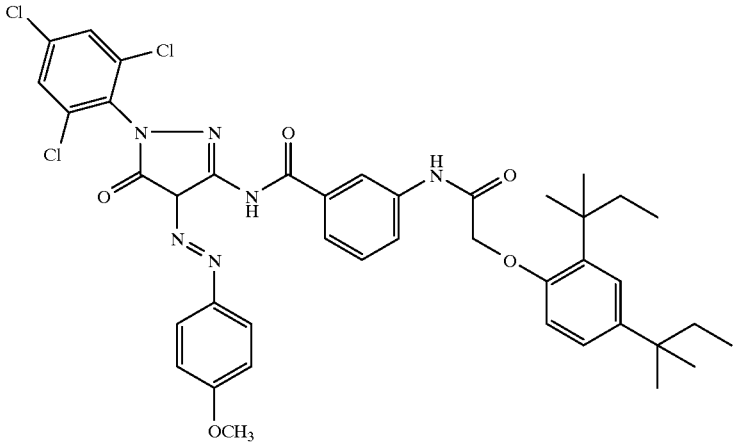
M-1
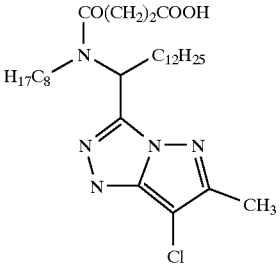
M-2
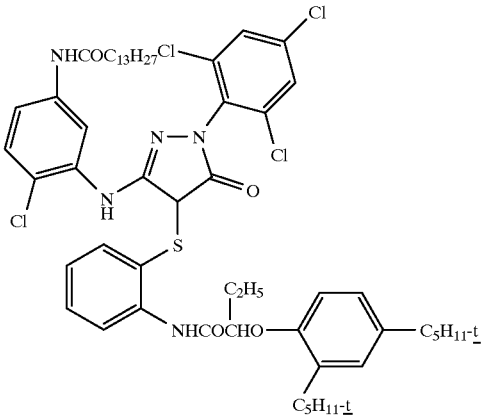
MC-1
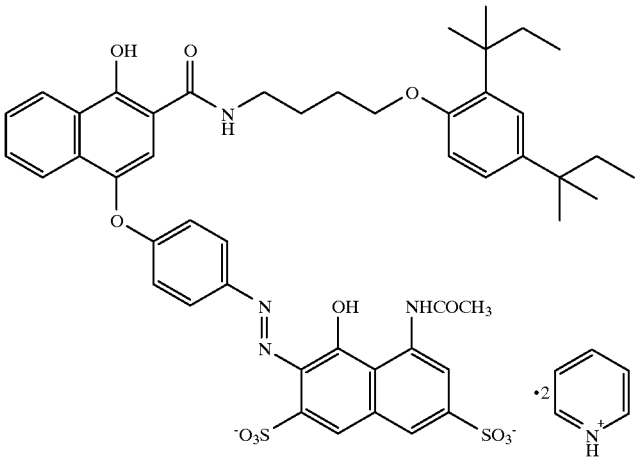

-continued
MC-2
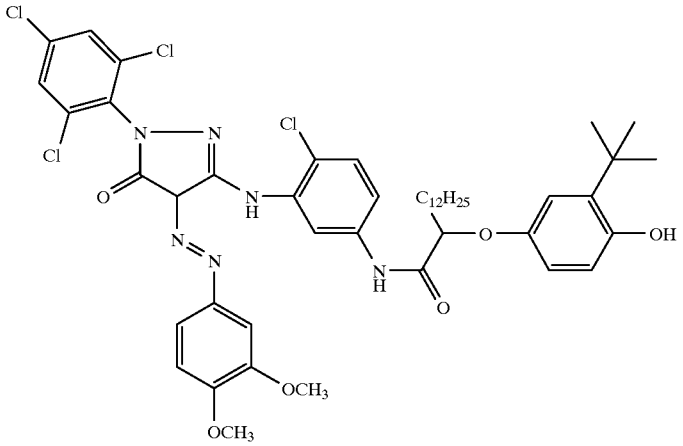
MC-3
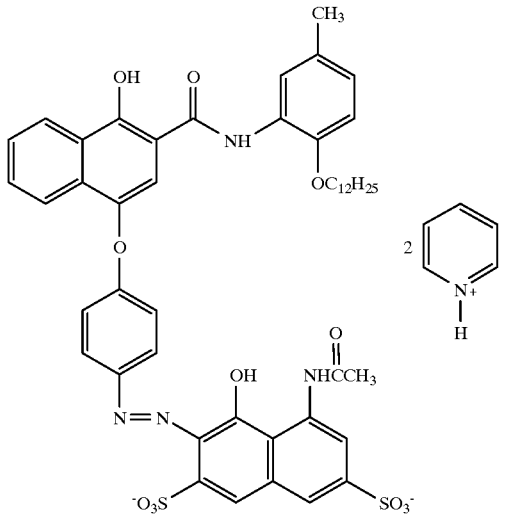
OxDS-1
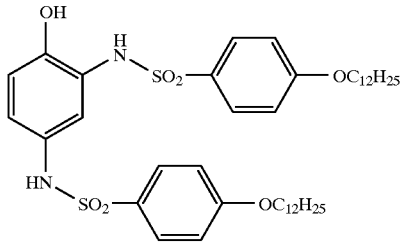
OxDS-2
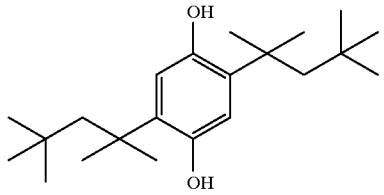
SD-1
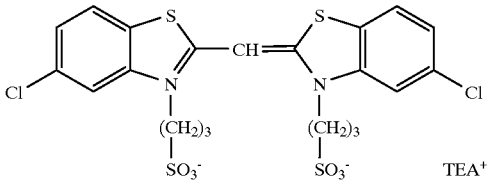

-continued
SD-2
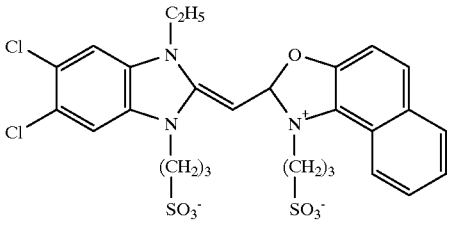
SD-3
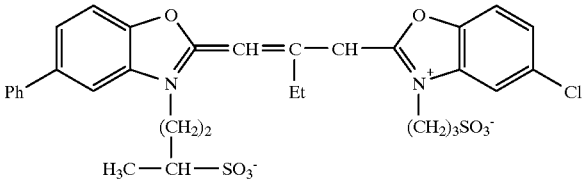
SD-4
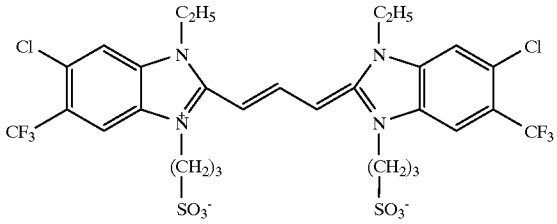
SD-5
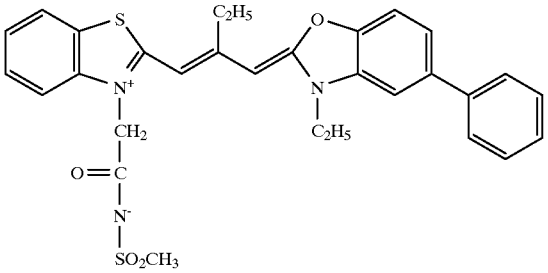
SD-6
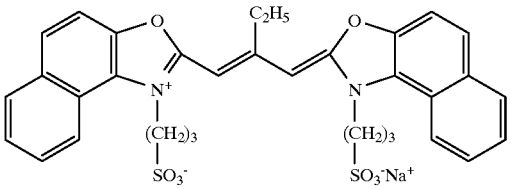
SD-7
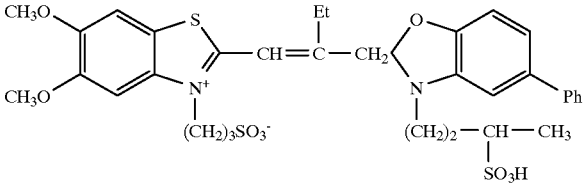
SD-8
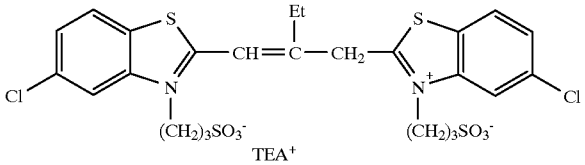

-continued
SD-9
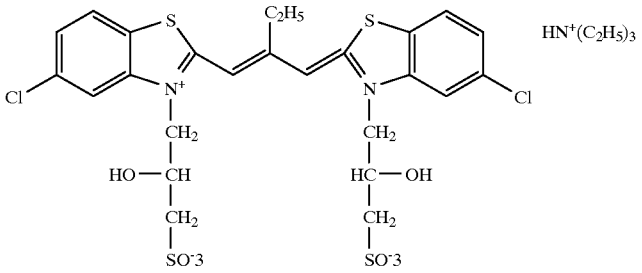
SD-10
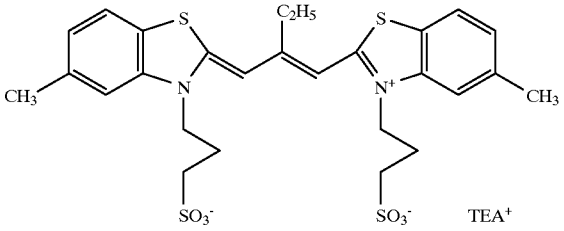
Y-1
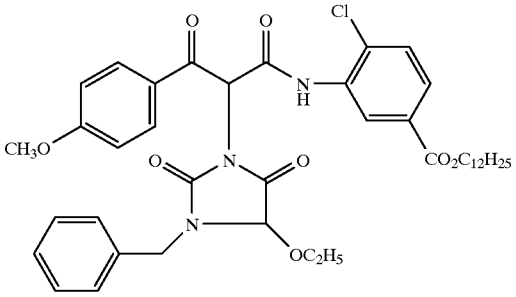
Y-2
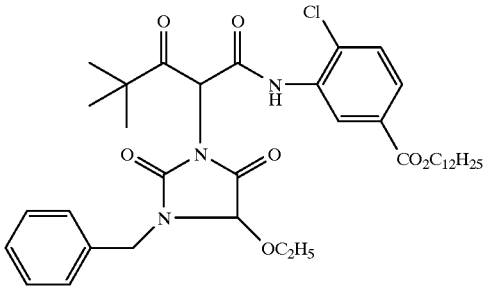

-continued

Y-3

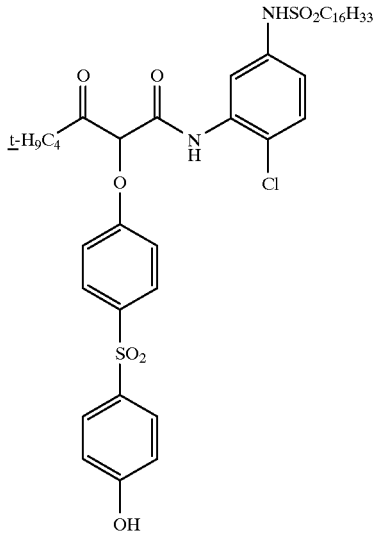

Y-4

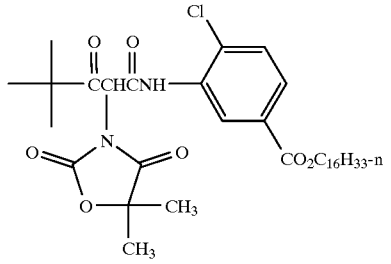

What is claimed is:

1. A photographic element comprising a support bearing one or more silver halide emulsion image-forming layers sensitive to blue light, one or more such layers sensitive to green light, and one or more such layers sensitive to red light, wherein the imaging silver, contained in the total of all the image-forming layers of the element, comprises larger grain sizes sufficient to provide an ISO speed of 100 or faster, and, is as described in subparts (1), (2) and (3):

(1) ultrathin tabular grains, having a thickness of less than 0.07 microns, comprise at least 25 wt % of the total imaging silver content of subparts (1), (2), and (3);

(2) (a) tabular grains of thickness at least 0.10 microns and (b) non-tabular grains having an ECD of at least 0.15 microns and less than 0.70 microns, comprise not more than 50 wt % of the total imaging silver content of subparts (1), (2), and (3); and (3) tabular grains having a thickness of at least 0.07 microns and a thickness less than 0.10 microns comprise not more than 50 wt % of the total imaging silver content of subparts (1), (2), and (3).

2. The element of claim 1 wherein the ultrathin tabular grains comprise at least 50 wt % of the total imaging silver content of subparts (1), (2), and (3).

3. The element of claim 2 wherein the ultrathin tabular grains comprise at least 65 wt % of the total imaging silver content of subparts (1), (2), and (3).

4. The element of claim 1 wherein the total imaging silver content in said silver halide emulsion image-forming layers is less than 35 mg/dm$^2$.

5. The element of claim 4 wherein the total imaging silver content in said silver halide emulsion image-forming layers is less than 30 mg/dm$^2$.

6. The element of claim 5 wherein the total imaging silver content in said silver halide emulsion image-forming layers is less than 25 mg/dm$^2$.

7. The element of claim 6 wherein the total imaging silver content in said silver halide emulsion image-forming layers is less than 20 mg/dm$^2$.

8. The element of claim 1 wherein the content of subpart (2) is less than 25 wt % of the total imaging silver content of subparts (1), (2), and (3).

9. The element of claim 8 wherein the content of subpart (2) is less than 12 wt % of the total imaging silver content of subparts (1), (2), and (3).

10. The element of claim 1 wherein the content of subpart (3) is less than 40 wt % of the total imaging silver content of subparts (1), (2), and (3).

11. The element of claim 10 wherein the content of subpart (2) is less than 25 wt % of the total imaging silver content of subparts (1), (2), and (3).

12. The element of claim 4 wherein the ultrathin tabular grains comprise at least 50 wt % of the total imaging silver content of subparts (1), (2), and (3).

13. The element of claim 12 wherein the ultrathin tabular grains comprise at least 65 wt % of the total imaging silver content of subparts (1), (2), and (3).

14. The element of claim 1 wherein there are present three color records each containing two or more silver halide imaging layers having different sensitivity to light, which records are sensitive respectively to blue, green, and red light, wherein at least one of the less light sensitive layers comprises at least 25 wt % ultrathin tabular grains.

15. The photographic element of claim 1 wherein ultrathin tabular grains comprise at least 50 wt % of the silver halide grain content of at least two image-forming layers.

16. The photographic element of claim 15 wherein said two layers are sensitized to different light colors.

17. The photographic element of claim 1 wherein at least one image-forming layer sensitized to each of blue, green, and red light contains at least 25 wt % ultrathin tabular grains in said layer.

18. The photographic element of claim 17 wherein said at least one image-forming layer sensitized to each of blue, green, and red light contains at least 50 wt % of ultrathin tabular grains in said layer.

19. A photographic element which comprises two or more silver halide emulsion layers containing imaging silver of differing sensitivity to light, at least two of said layers containing ultrathin tabular grains, wherein the imaging silver, contained in the total of all the image-forming layers of the element, is as described in subparts (1), (2) and (3):

(1) ultrathin tabular grains in the element comprise at least 25 wt % of the total imaging silver content of subparts (1), (2), and (3);

(2) (a) tabular grains of thickness at least 0.10 microns and (b) non-tabular grains having an ECD of at least 0.15 microns and less than 0.70 microns, comprise not more than 50 wt % of the total imaging silver content of subparts (1), (2), and (3); and (3) tabular grains having a thickness of at least 0.07 microns and a thickness less than 0.10 microns comprise not more than 50 wt % of the total imaging silver content of subparts (1), (2), and (3).

20. The element of claim 19 wherein the ultrathin tabular grains comprise at least 50 wt % of the total imaging silver content of subparts (1), (2), and (3).

21. The element of claim 20 wherein the ultrathin tabular grains comprise at least 65 wt % of the total imaging silver content of subparts (1), (2), and (3).

22. The element of claim 19 wherein the total imaging silver content in said silver halide emulsion image-forming layers is less than 35 mg/dm$^2$.

23. The element of claim 22 wherein the total imaging silver content in said silver halide emulsion image-forming layers is less than 30 mg/dm$^2$.

24. The element of claim 23 wherein the total imaging silver content in said silver halide emulsion image-forming layers is less than 25 mg/dm$^2$.

25. The element of claim 24 wherein the total imaging silver content in said silver halide emulsion image-forming layers is less than 20 mg/dm$^2$.

26. The element of claim 19 wherein the content of subpart (2) is less than 25 wt % of the total imaging silver content of subparts (1), (2), and (3).

27. The element of claim 26 wherein the content of subpart (2) is less than 12 wt % of the total imaging silver content of subparts (1), (2), and (3).

28. The element of claim 19 wherein the content of subpart (3) is less than 40 wt % of the total imaging silver content of subparts (1), (2), and (3).

29. The element of claim 28 wherein the content of subpart (2) is less than 25 wt % of the total imaging silver content of subparts (1), (2), and (3).

30. The element of claim 22 wherein the ultrathin tabular grains comprise at least 50 wt % of the total imaging silver content of subparts (1), (2), and (3).

31. The element of claim 30 wherein the ultrathin tabular grains comprise at least 65 wt % of the total imaging silver content of subparts (1), (2), and (3).

32. A method for forming an image in an element as described in claim 1 after it has been imagewise exposed to light comprising contacting the element with a photographic developing agent.

33. A method for forming an image in an element as described in claim 19 after it has been imagewise exposed to light comprising contacting the element with a photographic developing agent.

* * * * *